US009263053B2

(12) United States Patent
Ashley et al.

(10) Patent No.: US 9,263,053 B2
(45) Date of Patent: Feb. 16, 2016

(54) METHOD AND APPARATUS FOR GENERATING A CANDIDATE CODE-VECTOR TO CODE AN INFORMATIONAL SIGNAL

(71) Applicant: Motorola Mobility LLC, Libertyville, IL (US)

(72) Inventors: James P Ashley, Naperville, IL (US); Udar Mittal, Hoffman Estates, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 407 days.

(21) Appl. No.: 13/667,001

(22) Filed: Nov. 2, 2012

(65) Prior Publication Data

US 2014/0129214 A1 May 8, 2014

Related U.S. Application Data

(63) Continuation of application No. 13/439,121, filed on Apr. 4, 2012, now Pat. No. 9,070,356.

(51) Int. Cl.
*G10L 19/12* (2013.01)
*G10L 19/083* (2013.01)
(Continued)

(52) U.S. Cl.
CPC ..... *G10L 19/12* (2013.01); *G10L 19/083* (2013.01); *G10L 19/005* (2013.01); *G10L 2019/0013* (2013.01)

(58) Field of Classification Search
CPC ... G10L 19/083; G10L 19/005; G10L 19/012; G10L 19/08; G10L 19/0205; G10L 19/12; G10L 19/107; G10L 19/09; G10L 19/20; G10L 19/18; G10L 19/0204; G10L 19/26; G10L 19/125
USPC ..... 704/223, 219, 222, 220, 264, 229, 216, 704/218, 226, 230, 225, 207
See application file for complete search history.

(56) References Cited

U.S. PATENT DOCUMENTS 5,495,555 A * 2/1996 Swaminathan ..... 704/207
5,664,055 A * 9/1997 Kroon ..... 704/223
(Continued)

FOREIGN PATENT DOCUMENTS

EP 2648184 A1 10/2013
WO 9730525 A1 8/1997

OTHER PUBLICATIONS

Patent Cooperation Treaty, "PCT Search Report and Written Opinion of the International Searching Authority" for International Application No. PCT/US2013/067185, Dec. 20, 2013, 9 pages.
(Continued)

*Primary Examiner* — Vijay B Chawan
(74) *Attorney, Agent, or Firm* — Birch, Stewart, Kolasch & Birch, LLP

(57) ABSTRACT

A method (1100) and apparatus (100) generate a candidate code-vector to code an information signal. The method can include producing (1110) a weighted target vector from an input signal. The method can include processing (1120) the weighted target vector through an inverse weighting function to create a residual domain target vector. The method can include performing (1130) a first search process on the residual domain target vector to obtain an initial fixed codebook code-vector. The method can include performing (1140) a second search process over a subset of possible codebook code-vectors for a low weighted-domain error to produce a final fixed codebook code-vector. The subset of possible codebook code-vectors can be based on the initial fixed codebook code-vector. The method can include generating (1150) a codeword representative of the final fixed codebook code-vector. The codeword can be for use by a decoder to generate an approximation of the input signal.

20 Claims, 14 Drawing Sheets

(51) Int. Cl.
*G10L 19/005* (2013.01)
*G10L 19/00* (2013.01)

(56) References Cited

U.S. PATENT DOCUMENTS

| | | | | |
|---|---|---|---|---|
| 5,754,976 | A | 5/1998 | Adoul et al. | |
| 6,104,992 | A * | 8/2000 | Gao et al. | 704/220 |
| 6,236,960 | B1 | 5/2001 | Peng et al. | |
| 6,493,665 | B1 * | 12/2002 | Su et al. | 704/230 |
| 6,807,524 | B1 * | 10/2004 | Bessette et al. | 704/200.1 |
| 7,047,188 | B2 | 5/2006 | Jasiuk et al. | |
| 7,054,807 | B2 | 5/2006 | Mittal et al. | |
| 8,660,840 | B2 * | 2/2014 | Ananthapadmanabhan et al. | 704/230 |
| 2003/0097258 | A1 * | 5/2003 | Thyssen | 704/222 |
| 2004/0260542 | A1 * | 12/2004 | Ananthapadmanabhan et al. | 704/219 |
| 2005/0108007 | A1 * | 5/2005 | Bessette et al. | 704/223 |
| 2008/0294429 | A1 * | 11/2008 | Su et al. | 704/222 |
| 2008/0312917 | A1 * | 12/2008 | Ananthapadmanabhan et al. | 704/230 |
| 2009/0157395 | A1 * | 6/2009 | Su et al. | 704/207 |
| 2009/0182558 | A1 * | 7/2009 | Su et al. | 704/230 |
| 2010/0280831 | A1 * | 11/2010 | Salami et al. | 704/500 |
| 2012/0290295 | A1 * | 11/2012 | Eksler | 704/219 |
| 2013/0268266 | A1 | 10/2013 | Ashley et al. | |

OTHER PUBLICATIONS

European Patent Office, "Extended European Search Report" for Patent Application No. 13160603.0, Jul. 25, 2013, 9 pages.
International Telecommunication Union, "Series G: Transmission Systems and Media, Digital Systems and Networks; Digital terminal equipments—Coding of voice and audio signals; Frame error robust narrow-band and wideband embedded variable bit-rate coding of speech and audio from 8-32kkbit/s", Recommendation ITU-T G.718, Jun. 2008, 257 pages.
W. Bastiaan Kleijn et al., "Fast Methods for CELP Speech Coding Algorithm", IEEE Transactions on Acoustics, Speech, and Signal Processing, Aug. 1990, pp. 1330-1342, vol. 38 No. 8.
C. Laflamme et al., "On Reducing Computational Complexity of Codebook Search in CELP Coder Through the Use of the Algebraic Codes", IEEE Int'l Conf. on Acoustics, Speech and Signal Processing, Apr. 3-6, 1990, 177-80.
M. Elshafei Ahmed and M. I. Al-Suwaiyel, "Fast Methods for Code Search in CELP", IEEE Transactions on Speech and Audio Processing, Jul. 1993, pp. 315-325, vol. 1 No. 3.
Udar Mittal et al., "Low Complexity Factorial Pulse Coding of MDCT Coefficients Using Approximation of Combinatorial Functions", Int'l Conf. on Acoustics, Speech, and Signal Processing, Apr. 15-20, 2007, pp. 289-292.
James Ooi, "Application of Wavelets to Speech Coding", Massachusetts Institute of Technology, May 1993, 128 pages.
James P. Ashley and Udar Mittal, "Method and Apparatus for Generating a Candidate Code-Vector to Code an Information Signal", U.S. Appl. No. 13/439,121, filed Apr. 4, 2012, 38 pages.

* cited by examiner

METHOD AND APPARATUS FOR GENERATING A CANDIDATE CODE-VECTOR TO CODE AN INFORMATIONAL SIGNAL

CROSS REFERENCE TO RELATED APPLICATIONS

This application claims priority from U.S. patent application Ser. No. 13/439,121, entitled "Method and Apparatus for Generating a Candidate Code-Vector to Code an Informational Signal" by James P. Ashley and Udar Mittal filed Apr. 4, 2012. This related application is assigned to the assignee of the present application and is hereby incorporated herein in its entirety by this reference thereto.

BACKGROUND

1. Field

The present disclosure relates, in general, to signal compression systems and, more particularly, to Code Excited Linear Prediction (CELP)-type speech coding systems.

2. Introduction

Compression of digital speech and audio signals is well known. Compression is generally required to efficiently transmit signals over a communications channel or to compress the signals for storage on a digital media device, such as a solid-state memory device or computer hard disk. Although many compression techniques exist, one method that has remained very popular for digital speech coding is known as Code Excited Linear Prediction (CELP), which is one of a family of "analysis-by-synthesis" coding algorithms. Analysis-by-synthesis generally refers to a coding process by which multiple parameters of a digital model are used to synthesize a set of candidate signals that are compared to an input signal and analyzed for distortion. A set of parameters that yields a lowest distortion is then either transmitted or stored, and eventually used to reconstruct an estimate of the original input signal. CELP is a particular analysis-by-synthesis method that uses one or more codebooks where each codebook essentially includes sets of code-vectors that are retrieved from the codebook in response to a codebook index.

For example, FIG. 12 is a block diagram of a CELP encoder 1200 of the prior art. In CELP encoder 1200, an input signal s(n), such as a speech signal, is applied to a Linear Predictive Coding (LPC) analysis block 1201, where linear predictive coding is used to estimate a short-term spectral envelope. The resulting spectral parameters are denoted by the transfer function A(z). The spectral parameters are applied to an LPC Quantization block 1202 that quantizes the spectral parameters to produce quantized spectral parameters $A_q$ that are suitable for use in a multiplexer 1208. The quantized spectral parameters $A_q$ are then conveyed to multiplexer 1208, and the multiplexer 1208 produces a coded bitstream based on the quantized spectral parameters and a set of codebook-related parameters, τ, β, k, and γ, that are determined by a squared error minimization/parameter quantization block 1207.

The quantized spectral, or Linear Predictive, parameters are also conveyed locally to an LPC synthesis filter 1205 that has a corresponding transfer function $1/A_q(z)$. LPC synthesis filter 1205 also receives a combined excitation signal u(n) from a first combiner 1210 and produces an estimate of the input signal s(n) based on the quantized spectral parameters $A_q$ and the combined excitation signal u(n). Combined excitation signal u(n) is produced as follows. An adaptive codebook code-vector $c_\tau$ is selected from an adaptive codebook (ACB) 1203 based on an index parameter τ and the combined excitation signal from the previous subframe u(n-L). The adaptive codebook code-vector $c_\tau$ is then weighted based on a gain parameter β 1230 and the weighted adaptive codebook code-vector is conveyed to first combiner 1210. A fixed codebook code-vector $c_k$ is selected from a fixed codebook (FCB) 1204 based on an index parameter k. The fixed codebook code-vector $c_k$ is then weighted based on a gain parameter γ 1240 and is also conveyed to first combiner 1210. First combiner 1210 then produces combined excitation signal u(n) by combining the weighted version of adaptive codebook code-vector $c_\tau$ with the weighted version of fixed codebook code-vector $c_k$.

LPC synthesis filter 1205 conveys the input signal estimate ŝ(n) to a second combiner 1212. The second combiner 1212 also receives input signal s(n) and subtracts the estimate of the input signal ŝ(n) from the input signal s(n). The difference between input signal s(n) and the input signal estimate ŝ(n) is applied to a perceptual error weighting filter 1206, which filter produces a perceptually weighted error signal e(n) based on the difference between ŝ(n) and s(n) and a weighting function W(z). Perceptually weighted error signal e(n) is then conveyed to squared error minimization/parameter quantization block 1207. Squared error minimization/parameter quantization block 1207 uses the error signal e(n) to determine an optimal set of codebook-related parameters τ, β, k, and γ that produce the best estimate s(n) of the input signal s(n).

FIG. 13 is a block diagram of a decoder 1300 of the prior art that corresponds to the encoder 1200. As one of ordinary skilled in the art realizes, the coded bitstream produced by the encoder 1200 is used by a demultiplexer 1308 in the decoder 1300 to decode the optimal set of codebook-related parameters, τ, β 1330, k, and γ 1340. The decoder 1300 uses a process that is identical to the synthesis process performed by encoder 1200, by using an adaptive codebook 1303, a fixed codebook 1304, signals u(n) and u(n-L), code-vectors $c_\tau$ and $c_k$, and a LPC synthesis filter 1305 to generate output speech. Thus, if the coded bitstream produced by the encoder 1200 is received by the decoder 1300 without errors, the speech ŝ(n) output by the decoder 1300 can be reconstructed as an exact duplicate of the input speech estimate ŝ(n) produced by the encoder 1200.

While the CELP encoder 1200 is conceptually useful, it is not a practical implementation of an encoder where it is desirable to keep computational complexity as low as possible. As a result, FIG. 14 is a block diagram of an exemplary encoder 1400 of the prior art that utilizes an equivalent, and yet more practical, system compared to the encoding system illustrated by encoder 1200. To better understand the relationship between the encoder 1200 and the encoder 1400, it is beneficial to look at the mathematical derivation of encoder 1400 from encoder 1200. For the convenience of the reader, the variables are given in terms of their z-transforms.

From FIG. 12, it can be seen that the perceptual error weighting filter 1206 produces the weighted error signal e(n) based on a difference between the input signal and the estimated input signal, that is:

$$E(z)=W(z)(S(z)(S(z)-\hat{S}(z)) \quad (1)$$

From this expression, the weighting function W(z) can be distributed and the input signal estimate ŝ(n) can be decomposed into the filtered sum of the weighted codebook code-vectors:

$$E(z) = W(z)S(z) - \frac{W(z)}{A_q(z)}(\beta C_\tau(z) + \gamma C_k(z)) \quad (2)$$

The term W(z)S(z) corresponds to a weighted version of the input signal. By letting the weighted input signal W(z)S(z) be defined as $S_w(z)=W(z)S(z)$ and by further letting the weighted synthesis filter 1205 of the encoder 1200 now be defined by a transfer function $H(z)=W(z)/A_q(z)$, Equation 2 can rewritten as follows:

$$E(z)=S_w(z)-H(z)(\beta C_\tau(z)+\gamma C_k(z)) \quad (3)$$

By using z-transform notation, filter states need not be explicitly defined. Now proceeding using vector notation, where the vector length L is a length of a current speech input subframe, Equation 3 can be rewritten as follows by using the superposition principle:

$$e=s_w-H(\beta c_\tau+\gamma c_k)-h_{zir}, \quad (4)$$

where:

H is the L×L zero-state weighted synthesis convolution matrix formed from an impulse response of a weighted synthesis filter h(n), such as synthesis filters 1415 and 1405, and corresponding to a transfer function $H_{zs}(z)$ or H(z), which matrix can be represented as:

$$H = \begin{bmatrix} h(0) & 0 & \dots & 0 \\ h(1) & h(0) & \dots & 0 \\ \vdots & \vdots & \ddots & \vdots \\ h(L-1) & h(L-2) & \dots & h(0) \end{bmatrix}, \quad (5)$$

$h_{zir}$ is a L×1 zero-input response of H(z) that is due to a state from a previous speech input subframe, $s_w$ is the L×1 perceptually weighted input signal, β is the scalar adaptive codebook (ACB) gain, $c_\tau$ is the L×1 ACB code-vector indicated by index τ, γ is the scalar fixed codebook (FCB) gain, and $c_k$ is the L×1 FCB code-vector indicated by index k.

By distributing H, and letting the input target vector $x_w=s_w-h_{zir}$, the following expression can be obtained:

$$e=x_w-\beta Hc_\tau-\gamma Hc_k \quad (6)$$

Equation 6 represents the perceptually weighted error (or distortion) vector e(n) produced by a third combiner 1408 of encoder 1400 and coupled by the combiner 1408 to a squared error minimization/parameter quantization block 1407.

From the expression above, a formula can be derived for minimization of a weighted version of the perceptually weighted error, that is, $\|e\|^2$, by squared error minimization/parameter quantization block 1407. A norm of the squared error is given as:

$$\epsilon=\|e\|^2=\|x_w-\beta Hc_\tau-\gamma Hc_k\|^2 \quad (7)$$

Note that $\|e\|^2$ may also be written as $\|e\|^2=\Sigma_{n=0}^{L-1}e^2(n)$ or $\|e\|^2=e^Te$, where $e^T$ is the vector transpose of e, and is presumed to be a column vector.

Due to complexity limitations, practical implementations of speech coding systems typically minimize the squared error in a sequential fashion. That is, the adaptive codebook (ACB) component is optimized first by assuming the fixed codebook (FCB) contribution is zero, and then the FCB component is optimized using the given (previously optimized) ACB component. The ACB/FCB gains, that is, codebook-related parameters β and γ, may or may not be re-optimized, that is, quantized, given the sequentially selected ACB/FCB code-vectors $c_\tau$ and $c_k$.

The theory for performing such an example of a sequential optimization process is as follows. First, the norm of the squared error as provided in Equation 7 is modified by setting γ=0, and then expanded to produce:

$$\epsilon=\|x_w-\beta Hc_\tau\|^2=x_x^Tx_w-2\beta x_w^THc_\tau+\beta^2c_\tau^TH^THc_\tau \quad (8)$$

Minimization of the squared error is then determined by taking the partial derivative of ϵ with respect to β and setting the quantity to zero:

$$\frac{\partial\varepsilon}{\partial\beta} = x_w^THc_\tau - \beta c_\tau^TH^THc_\tau = 0 \quad (9)$$

This yields an optimal ACB gain:

$$\beta = \frac{x_w^THc_\tau}{c_\tau^TH^THc_\tau} \quad (10)$$

Substituting the optimal ACB gain back into Equation 8 gives:

$$\tau^* = \underset{\tau}{\operatorname{argmin}}\left\{x_w^Tx_w - \frac{(x_w^THc_\tau)^2}{c_\tau^TH^THc_\tau}\right\}, \quad (11)$$

where τ* is an optimal ACB index parameter, that is, an ACB index parameter that minimizes the bracketed expression. Typically, τ is a parameter related to a range of expected values of the pitch lag (or fundamental frequency) of the input signal, and is constrained to a limited set of values that can be represented by a relatively small number of bits. Since $x_w$ is not dependent on τ, Equation 11 can be rewritten as follows:

$$\tau^* = \underset{\tau}{\operatorname{argmax}}\left\{\frac{(x_w^THc_\tau)^2}{c_\tau^TH^THc_\tau}\right\} \quad (12)$$

Now, by letting $y_\tau$ equal the ACB code-vector $c_\tau$ filtered by weighted synthesis filter 1415, that is, $y_\tau=Hc_\tau$, Equation 13 can be simplified to:

$$\tau^* = \underset{\tau}{\operatorname{argmax}}\left\{\frac{(x_w^Ty_\tau)^2}{y_\tau^Ty_\tau}\right\}, \quad (13)$$

and likewise, Equation 10 can be simplified to:

$$\beta = \frac{x_w^Ty_\tau}{y_\tau^Ty_\tau} \quad (14)$$

Thus Equations 13 and 14 represent the two expressions necessary to determine the optimal ACB index τ and ACB gain β in a sequential manner. These expressions can now be used to determine the optimal FCB index and gain expressions. First, from FIG. 14, it can be seen that a second combiner 1406 produces a vector $x_2$, where $x_2=x_w-\beta Hc_\tau$. The vector $x_w$ (or $x_w(n)$) is produced by a first combiner 1404 that subtracts a filtered past synthetic excitation signal $h_{zir}(n)$, after filtering past synthetic excitation signal u(n-L) by a weighted synthesis zero input response $H_{zir}(z)$ filter 1401, from an output $s_w(n)$ of a perceptual error weighting filter W(z) 1402 of input speech signal s(n). The term $\beta Hc_\tau$ is a filtered and weighted version of ACB code-vector $c_\tau$, that is, ACB code-vector $c_\tau$ filtered by zero state weighted synthesis filter $H_{zs}(z)$ 1415 to generate y(n) and then weighted based on ACB gain parameter β 1430. Substituting the expression $x_2=x_w-\beta Hc_\tau$ into Equation 7 yields:

$$\epsilon=\|_2-\gamma Hc_k\|^2, \tag{15}$$

where $\gamma Hc_k$ is a filtered and weighted version of FCB code-vector $c_k$, that is, FCB code-vector $c_k$ filtered by zero state weighted synthesis filter $H_{zs}(z)$ 1405 and then weighted based on FCB gain parameter γ 1440. Similar to the above derivation of the optimal ACB index parameter τ*, it is apparent that:

$$k^* = \underset{k}{\operatorname{argmax}}\left\{\frac{(x_2^T Hc_k)^2}{c_k^T H^T Hc_k}\right\}, \tag{16}$$

where k* is an optimal FCB index parameter, that is, an FCB index parameter that maximizes the bracketed expression. By grouping terms that are not dependent on k, that is, by letting $d_2^T=x_2^T H$ and $\Phi=H^T H$, Equation 16 can be simplified to:

$$k^* = \underset{k}{\operatorname{argmax}}\left\{\frac{(d_2^T c_k)^2}{c_k^T \Phi c_k}\right\}, \tag{17}$$

in which the optimal FCB gain γ is given as:

$$\gamma = \frac{d_2^T c_k}{c_k^T \Phi c_k}. \tag{18}$$

The encoder 1400 provides a method and apparatus for determining the optimal excitation vector-related parameters τ, β, k, and γ. Unfortunately, higher bit rate CELP coding typically requires higher computational complexity due to a larger number of codebook entries that require error evaluation in the closed loop processing. Thus, there is an opportunity for generating a candidate code-vector to reduce the computational complexity to code an information signal.

DETAILED DESCRIPTION

As discussed above, higher bit rate CELP coding typically requires higher computational complexity due to a larger number of codebook entries that require error evaluation in the closed loop processing. Embodiments of the present disclosure can solve a problem of searching higher bit rate codebooks by providing for pre-quantizer candidate generation in a Code Excited Linear Prediction (CELP) speech coder. Embodiments can address the problem by generating a set of initial FCB candidates through direct quantization of a set of vectors formed using inverse weighting functions and the FCB target signal and then evaluating a weighted error of those initial candidates to produce a better overall code-vector. Embodiments can also apply variable weights to vectors and can sum the weighted vectors as part of preselecting candidate code-vectors. Embodiments can additionally generate a set of initial fixed codebook candidates through direct quantization of a set of vectors formed using inverse weighting functions and the fixed codebook target signal and then evaluate the weighted errors of that initial set of candidates to produce a better overall code-vector. Other embodiments can also generate a set of initial FCB candidates through direct quantization of a set of vectors formed using inverse weighting functions and the FCB target signal, and then evaluating a weighted error of those initial candidates to determine a better initial weighting function for a given pre-quantizer function.

To achieve the above benefits, a method and apparatus can generate a candidate code-vector to code an information signal. The method can include producing a weighted target vector from an input signal. The method can include processing the weighted target vector through an inverse weighting function to create a residual domain target vector. The method can include performing a first search process on the residual domain target vector to obtain an initial fixed codebook code-vector. The method can include performing a second search process over a subset of possible codebook code-vectors for a low weighted-domain error to produce a final fixed codebook code-vector. The subset of possible codebook code-vectors can be based on the initial fixed codebook code-vector. The method can include generating a codeword representative of the final fixed codebook code-vector. The codeword can be for use by a decoder to generate an approximation of the input signal.

Figure 1:
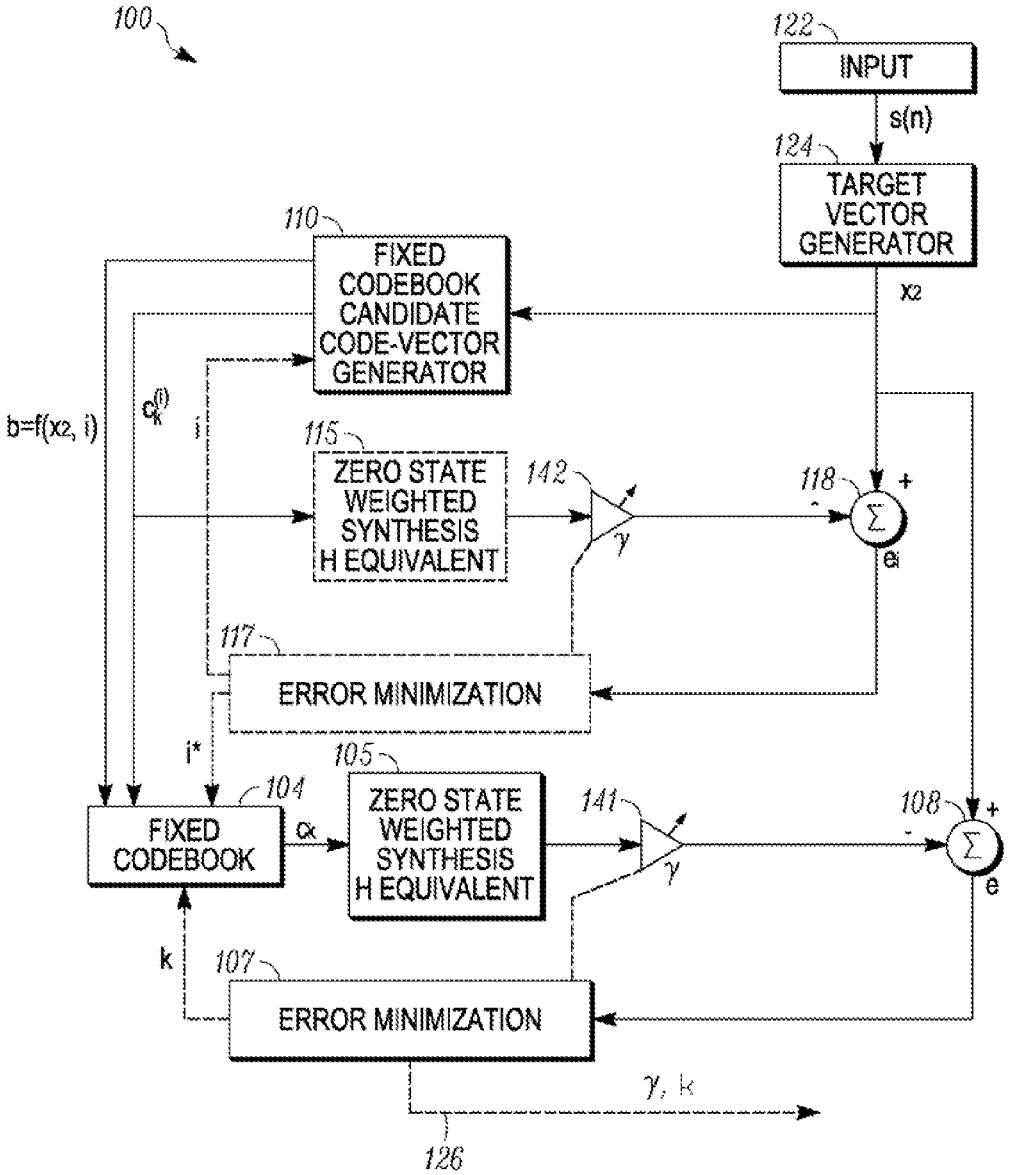
FIG. 1 is an example block diagram of at least a portion of a coder, such as a portion of the coder in FIG. 12, according to one embodiment.

FIG. 1 is an example block diagram of at least a portion of a coder apparatus 100, such as a portion of the coder 1200, according to one embodiment. The coder 100 can include an input 122, a target vector generator 124, a FCB candidate code-vector generator 110, a FCB 104, a zero state weighted synthesis filter H equivalent 105, an error minimization block 107, a first gain parameter γ weighting block 141, a combiner 108, and an output 126. The coder 100 can also include a second zero state weighted synthesis filter H equivalent 115, a second error minimization block 117, a second gain parameter γ weighting block 142, and a second combiner 118.

Figure 14:
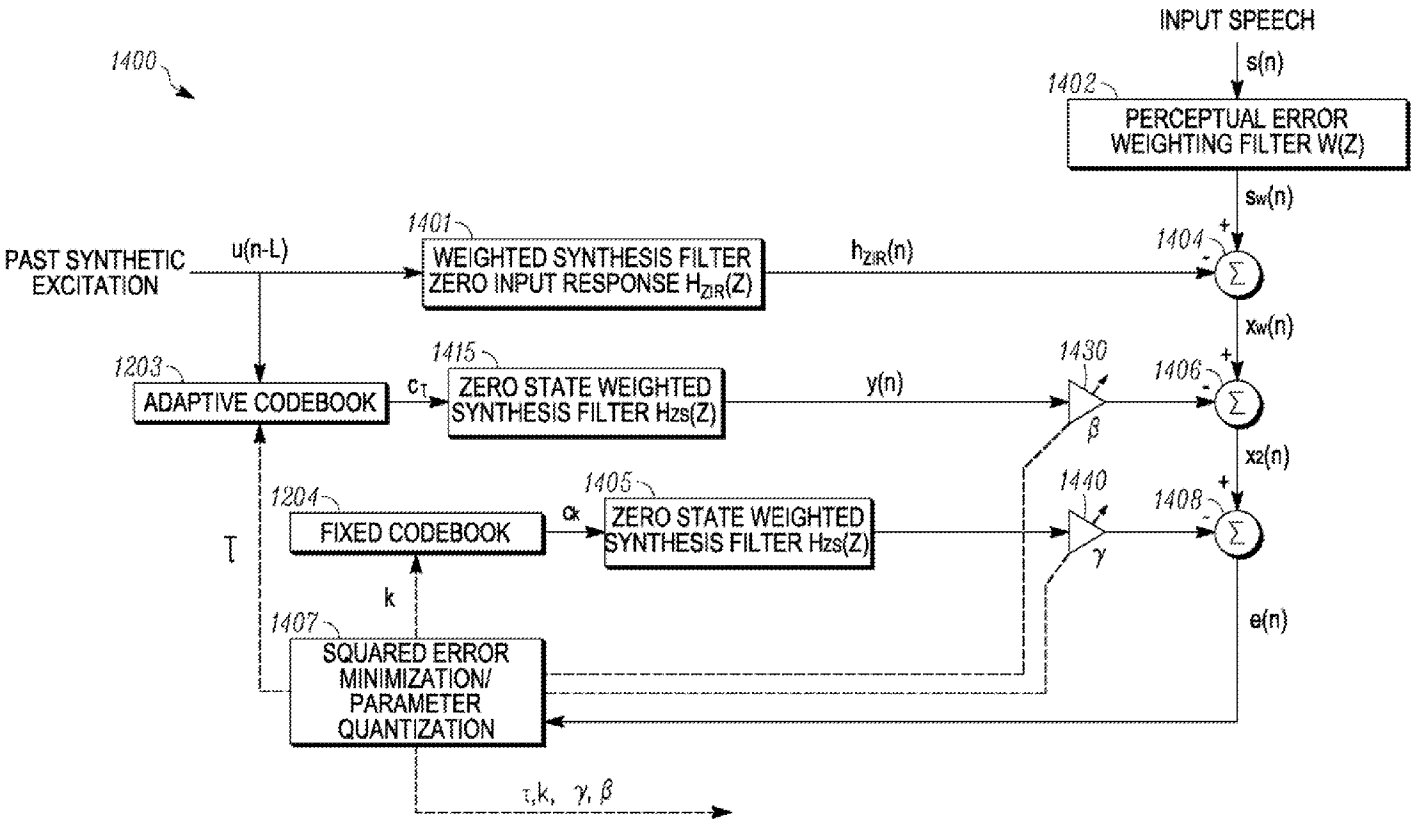
PRIOR ART FIG. 14
FIG. 14 is a block diagram of another CELP encoder of the prior art.

The zero state weighted synthesis filter equivalent 105, the error minimization block 107, and the combiner 108, as well as the second zero state weighted synthesis filter H equivalent 115, the second error minimization block 117, and the second combiner 118 can operate similarly to the zero state weighted synthesis filter 1405, the squared error minimization parameter quantizer 1407, and the combiner 1408, respectively, as illustrated in FIG. 14. Note that a zero state weighted synthesis filter H is not actually implemented, but rather a mathematical equivalent is implemented as discussed with respect to Eqs. 16, 17, and 18. A codebook, such as the FCB 104, can include of a set of pulse amplitude and position combinations. Each pulse amplitude and position combination can define L different positions and can include both zero-amplitude pulses and non-zero-amplitude pulses assigned to respective positions p=1, 2, . . . , L−1 of the combination.

In operation, the input 122 can receive and may process an input signal s(n). The input signal s(n) can be a digital or analog input signal. The input can be received wirelessly, through a hard-wired connection, from a storage medium, from a microphone, or otherwise received. For example, the input signal s(n) can be based on an audible signal, such as speech. The target vector generator 124 can receive the input signal s(n) from the input 122 and can produce a target vector $x_2$ from the input signal s(n).

The FCB candidate code-vector generator 110 can receive the target vector $x_2$ and can construct a set of candidate code-vectors $c_k^{[i]}$ and an inverse weighting function $f(x_2,i)$, where i can be an index for the candidate code-vectors $c_k^{[i]}$ where $0 \le i < N$, and N is at least one. The set of candidate code-vectors $c_k^{[i]}$ can be based on the target vector $x_2$ and can be based on the inverse weighting function. The inverse weighting function can remove weighting from the target vector $x_2$ in some manner. For example, an inverse weighting function can be based on $$f(x_2, i) = a_i \frac{r}{\|r\|} + b_i \frac{d_2}{\|d_2\|},$$

described below, or can be other inverse weighting functions described below. Additionally, the FCB 104 may also use the inverse weighting function result as a means of further reducing the search complexity, for example, by searching only a subset of the total pulse/position combinations.

The error minimization block 117 may also select one of a plurality of candidate code-vectors $c_k^{[i]}$ with lower squared sum value of $e_i$ as $c_k^{i*}$. That is, after the best candidate code-vector $c_k^{i*}$ is found by way of square error minimization, the fixed codebook 104 may use $c_k^{i*}$ as an initial "seed" code-vector which may be iterated upon. The inverse weighting function result $f(x_2, i^*)$ may also be used in this process to help reduce search complexity. Thus, i* can represent the index value of the optimum candidate code-vector $c_k^{[i]}$. If the coder 100 does not include the second zero state weighted synthesis filter H equivalent 115, the second error minimization block 117, the second gain parameter γ weighting block 142, and the second combiner 118, the remaining blocks can perform the corresponding functions. For example, the error minimization block 107 can provide the indices i of the candidate code-vectors and the index value i* of the optimum candidate code-vector and the zero state weighted synthesis filter 105 can receive the candidate code-vectors $c_k^{[i]}$ (not shown).

According to an example embodiment, the FCB candidate code-vector generator 110 can construct the set of candidate code-vectors $c_k^{[i]}$ based on the target vector $x_2$, based on an inverse filtered vector, and based on a backward filtered vector as described below. The set of candidate code-vectors $c_k^{[i]}$ can also be based on the target vector $x_2$ and based on a sum of a weighted inverse filtered vector and weighted backward filtered vector as described below.

In the case where the number of candidate code-vectors is greater than one (N>1 and $0 \le i < N$), the error minimization block 117 can evaluate an error vector $e_i$ associated with each of the plurality of candidate code-vectors $c_k^{[i]}$. The error vector can be analyzed to select a single FCB code-vector $c_k^{[i^*]}$, where the FCB code-vector $c_k^{[i^*]}$ can be one of the candidate code-vectors $c_k^{[i]}$. The squared error minimization/parameter quantization block 107 can generate a codeword k representative of the FCB code-vector $c_k^{[i]}$. The codeword k can be used by a decoder to generate an approximation $\hat{s}(n)$ of the input signal s(n). The error minimization block 107 or another element can output the codeword k at the output 126 by transmitting the codeword k and/or storing the codeword k. For example, the error minimization block 117 may generate and output the codeword k.

Each candidate code-vector $c_k^{[i]}$ can be processed as if it were generated by the FCB 104 by filtering it through the zero state weighted synthesis filter 105 for each candidate $c_k^{[i]}$. The FCB candidate code-vector generator 110 can evaluate an error value associated with each iteration of the plurality of candidate code-vectors $c_k^{[i]}$ from the plurality of times to produce a FCB code-vector $c_k$ based on the candidate code-vector $c_k^{[i]}$ with the lowest error value.

According to some embodiments, there can be multiple inverse functions $f(x_2,i)$, where $0 <= i < N$ and N>1, evaluated for every frame of speech. Multiple $f(x_2,i)$ outputs can be used to determine a codebook output, which can be $c_k^{[i]}$ or $c_k$. Additionally, $c_k^{[i]}$ can be a starting point for determining $c_k$, where $c_k^{[i]}$ can allow for fewer iterations of k and can allow for a better overall result by avoiding settling on a local minima and missing a more global minimum error ϵ.

Figure 2:
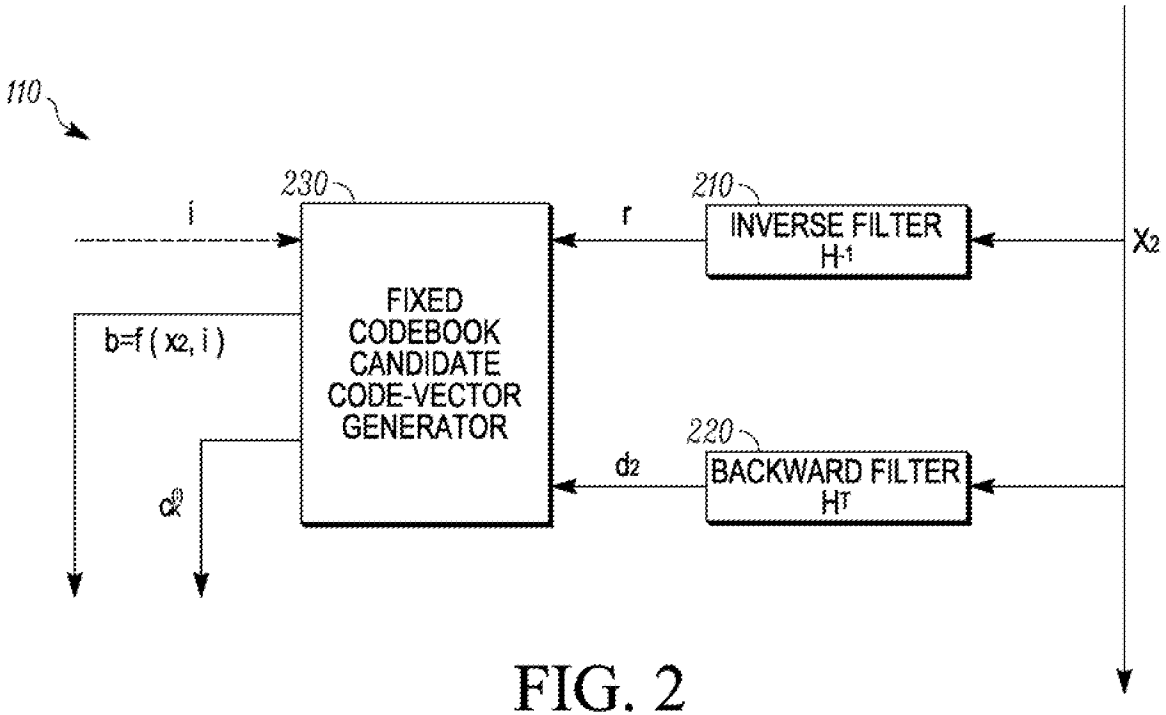
FIG. 2 is an example block diagram of a FCB candidate code-vector generator according to one embodiment.

FIG. 2 is an example block diagram of the FCB candidate code-vector generator 110 according to one embodiment. The FCB candidate code-vector generator 110 can include an inverse filter 210, a backward filter 220, and another processing block for a FCB candidate code-vector generator 230.

The FCB candidate code-vector generator 110 can construct a set of candidate code-vectors $c_k^{[i]}$, where i can be an index for the candidate code-vectors $c_k^{[i]}$. The set of candidate code-vectors $c_k^{[i]}$ can be based on the target vector $x_2$ and can be based on an inverse weighting function, such as $f(x_2,i)$. The inverse weighting function can be based on an inverse filtered vector and the inverse filter 210 can construct the inverse filtered vector from the target vector $x_2$. For example, the inverse filtered vector can be constructed based on $r=H^{-1}x_2$, where r can be the inverse filtered vector, where $H^{-1}$ can be a zero-state weighted synthesis convolution matrix formed from an impulse response of a weighted synthesis filter, and where $x_2$ can be the target vector. Other variations are described in other embodiments.

The inverse weighting function can be based on a backward filtered vector, and the backward filter 220 can construct the backward filtered vector from the target vector $x_2$. For example, the backward filtered vector can be constructed based on $d_2=H^T x_2$, where $d_2$ can be the backward filtered vector, where $H^T$ can be a transpose of a zero-state weighted synthesis convolution matrix formed from an impulse response of a weighted synthesis filter, and where $x_2$ can be the target vector. Other variations are described in other embodiments.

According to an example embodiment, recalling Eq. 15 from the Background that $$\epsilon=\|x_2-\gamma H c_k\|^2, \tag{19}$$

if the FCB code-vector is given as:

$$c_k = \frac{1}{\gamma} H^{-1} x_2, \tag{20}$$

then the error $\epsilon$ can tend to zero and the input signal s(n) and a corresponding coded output signal $\hat{s}(n)$ can be identical. Since this is not practical for low rate speech coding systems, only a crude approximation of Eq. 20 is typically generated. U.S. Pat. No. 5,754,976 to Adoul, hereby incorporated by reference, discloses one example of the usage of the inverse filtered target signal $r=H^{-1}x_2$ as a method for low bit rate pre-selection of the pulse amplitudes of the code-vector $c_k$.

One of the problems in evaluating the error term $\epsilon$ in Eq. 19 is that, while the error $\epsilon$ is evaluated in the weighted synthesis domain, the FCB code-vector $c_k$ is generated in the residual domain. Thus, a direct PCM-like quantization of the right hand term in Eq. 20 does not generally produce the minimum possible error in Eq. 19, due to the quantization error generation being in the residual domain as opposed to the weighted synthesis domain. More specifically, the expression:

$$c_k = Q_P\left\{\frac{1}{\gamma} H^{-1} x_2\right\}, \tag{21}$$

where $Q_P\{\ \}$ is a P-bit quantization operator, does not generally lead to the global minimum weighted error since the error due to $Q_P\{\ \}$ is a residual domain error. In order to achieve the lowest possible error in the weighted synthesis domain, many iterations of $c_k$ may be necessary to minimize the error $\epsilon$ of Eq. 19. Various embodiments of the present disclosure described below can address this problem by reducing the iterations and by reducing the residual domain error.

First, an i-th pre-quantizer candidate $c_k^{[i]}$ can be generated by the FCB candidate code-vector generator 110 using the expression $$c_k^{[i]}=Q_P\{f(x_2,i)\},\ 0\le i<N, \tag{22}$$

where $f(x_2,i)$ can be some function of the target vector, and N can be the number of pre-quantizer candidates. This expression can be a generalized form for generating a plurality of pre-quantizer candidates that can be assessed for error in the weighted domain. An example of such a function is given as:

$$f(x_2, i) = a_i \frac{r}{\|r\|} + b_i \frac{d_2}{\|d_2\|}, \tag{23}$$

where $r=H^{-1}x_2$ is the inverse filtered target signal, $d_2=H^T x_2$ is the backward filtered target as calculated/defined in Eq. 17, and $a_i$ and $b_i$ are a set of respective weighting coefficients for iteration i. Here, $\|r\|$ can be a norm of the residual domain vector r, such as the inverse filtered target vector r, given by $\|r\|=\sqrt{r^T r}$, and likewise $\|d_2\|=\sqrt{d_2^T d_2}$. The effect of coefficients $a_i$ and $b_i$, can be to produce a weighted sum of the inverse and backward filtered target vectors, which can then form the set of pre-quantizer candidate vectors.

Embodiments of the present disclosure can allow various coefficient functions to be incorporated into the weighting of the normalized vectors in Eq. 23. For example, the functions:

$$a_i = 1 - i/(N-1), \quad b_i = i/(N-1), \quad 0 \le i < N, \tag{24}$$

where candidates can have a linear distribution of values over a given range. As an example, if N=4, the sets of coefficients can be: $a_i \in \{1.0, 0.667, 0.333, 0.0\}$, and $b_i \in \{0.0, 0.333, 0.667, 1.0\}$. Another example may incorporate the results of a training algorithm, such as the Linde-Buzo-Gray (or LBG) algorithm, where many values of a and b can be evaluated offline using a training database, and then choosing a, and b, based on the statistical distributions. Such methods for training are well known in the art. Other functions can also be possible. For example, the following function may be found to be beneficial for certain classes of signals:

$$f(x_2,i)=a_i r+b_i r_{lpf}, \tag{25}$$

where $r_{lpf}$ can be a low pass filtered version of r. Alternatively, the LPF characteristic may be altered as a function of i:

$$f(x_2,i)=B_i r; \tag{26}$$

where $B_i$ may be a class of linear phase filtering characteristics intended to shape the residual domain quantization error in a way that more closely resembles that of the error in the weighted domain. Yet another method may involve specifying a family of inverse perceptual weighting functions that may also shape the error in a way that is beneficial in shaping the residual domain error:

$$f(x_2,i)=H^{-1}x_2, \tag{27}$$

The weighted signal can then be quantified into a form that can be utilized by the particular FCB coding process. U.S. Pat. No. 5,754,976 to Adoul and U.S. Pat. No. 6,236,960 to Peng, hereby incorporated by reference, disclose coding methods that use unit magnitude pulse codebooks that are algebraic in nature. That is, the codebooks are generated on the fly, as opposed to being stored in memory, searching various pulse position and amplitude combinations, finding a low error pulse combination, and then coding the positions and amplitudes using combinatorial techniques to form a codeword k that is subsequently used by a decoder to regenerate $c_k$ and further generate an approximation $\hat{s}(n)$ of the input signal s(n).

According to one embodiment, the codebook disclosed in U.S. Pat. No. 6,236,960 can be used to quantify the inverse weighted signal into a form that can be utilized by the particular FCB coding process. The i-th pre-quantizer candidate $c_k^{[i]}$ may be obtained from Eq. 22 by iteratively adjusting a gain term $g_Q$ as:

$$c_k^{[i]} = \text{round}(g_Q f(x_2, i)): \sum_n |c_k^{[i]}(n)| = m, \tag{28}$$

where the round( ) operator rounds the respective vector elements of $g_Q f(x_2,i)$ to the nearest integer value, where n represents the n-th element of vector $c_k^{[i]}$, and m is the total number of unit magnitude pulses. This expression describes a process of selecting $g_Q$ such that the total number of unit amplitude pulses in $c_k^{[i]}$ equals m.

It is also not necessary for $c_k^{[i^*]}$ to contain the exact number of pulses as allowed by the FCB. For example, the FCB configuration may allow $c_k$ to contain 20 pulses, but the pre-quantizer stage may use only 10 or 15 pulses. The remaining pulses can be placed by the post search, which will be described later with respect to FIG. 9. In another case, the pre-quantizer stage may place more pulses than allowed by the FCB configuration. In this embodiment, the post search may remove pulses in a way that attempts to minimize the weighted error. In one embodiment, however, the number of pulses in the pre-quantizer vector can be generally equal to the number of pulses allowed by a particular FCB configuration. In this case, the post search may involve removing a unit magnitude pulse from one position and placing the pulse at a different location that results in a lower weighted error. This process may be repeated until the codebook converges or until a predetermined maximum number of iterations is reached.

To further expand on the above embodiments where the candidate code-vectors $c_k^{[i]}$ and the eventual FCB output vector $c_k$ may or may not contain the same number of unit magnitude pulses, another embodiment exists where the candidate codebook for generating $c_k^{[i]}$ may be different than the codebook for generating $c_k$. That is, the best candidate $c_k^{[i^*]}$ may generally be used to reduce complexity or improve overall performance of the resulting code-vector $c_k$, by using $c_k^{[i^*]}$ as a means for determining the best inverse function $f(x_2,i^*)$, and then proceeding to use $f(x_2,i^*)$ as a means for searching a second codebook $c'_k$. Such an example may include using a Factorial Pulse Coded (FPC) codebook for generating $c_k^{[i^*]}$, and then using a traditional ACELP codebook to generate $c'_k$, wherein the inverse function $f(x_2,i^*)$ is used in the secondary codebook search $c'_k$, and the candidate code-vectors $c_k^{[i]}$ are discarded. In this way, for example, the pre-selection of pulse signs for the secondary codebook $c'_k$ may be based on a plurality of inverse functions $f(x_2,i)$, and not directly on the candidate code-vectors $c_k^{[i]}$. This embodiment may allow performance improvement to existing codecs that use a specific codebook design, while maintaining interoperability and backward compatibility.

In another embodiment, a very large value of N may be used. For example, if N=100, then the weighting coefficients $[a_i\ b_i]$ can span a very high resolution set, and can result in a solution that will yield optimal results.

According to U.S. Pat. No. 7,054,807 to Mittal, which is hereby incorporated by reference, the ACB/FCB parameters may be jointly optimized. The joint optimization can also be used for evaluation of N pre-quantizer candidates. Now Eq. 17 can become:

$$i^* = \underset{0\le i<N}{\operatorname{argmax}}\left\{\frac{(d_2^T c_k^{[i]})^2}{c_k^{[i]T}\Phi' c_k^{[i]}}\right\}, \tag{29}$$

where $\Phi'=\Phi-yy^T$ and where y can be a scaled backward filtered ACB excitation. Now i* may be determined through brute force computation:

$$i^* = \underset{0\le i<N}{\operatorname{argmax}}\left\{\frac{(x_2^T y_2^{[i]})^2}{y_2^{[i]T} y_2^{[i]} - (y^T c_k^{[i]})^2}\right\}, \tag{30}$$

where $y_2^{[i]}=Hc_k^{[i]}$ can be the i-th pre-quantizer candidate filtered though the zero state weighted synthesis filter 105 and $y^T c_k^{[i]}$ can be a correlation between the i-th pre-quantizer candidate and the scaled backward filtered ACB excitation.

Figure 3:
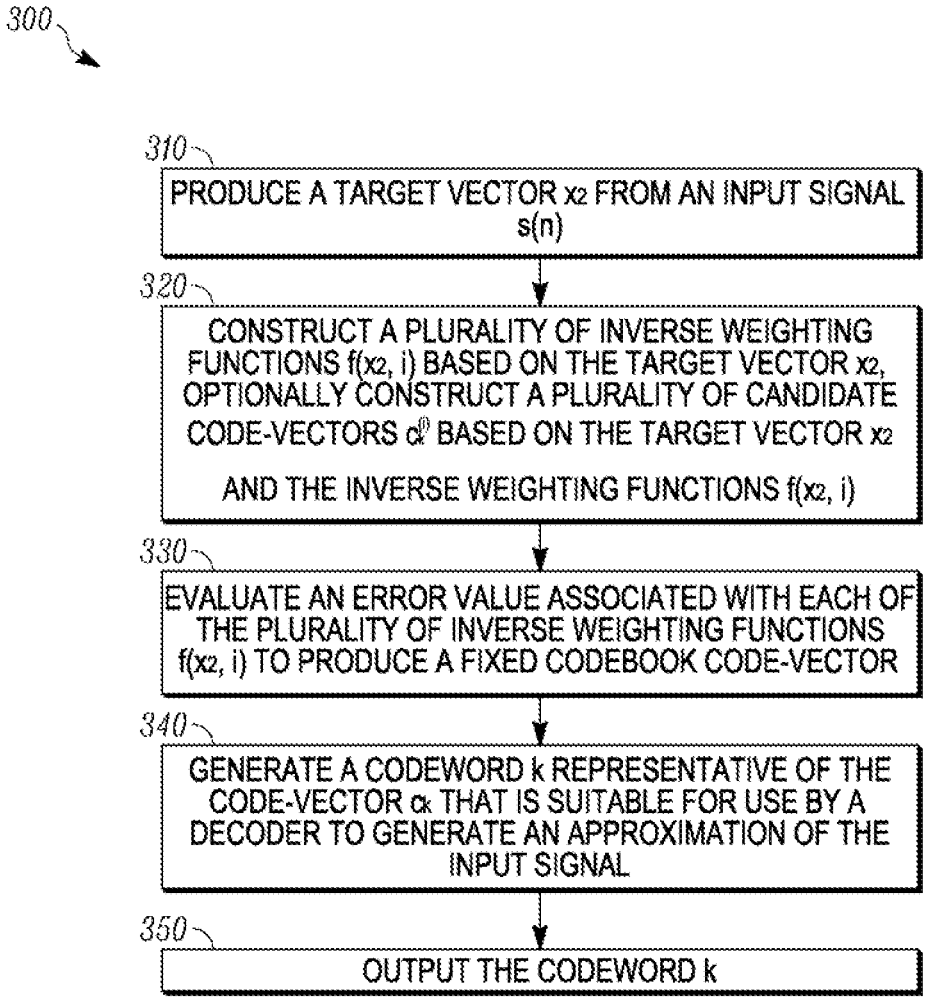
FIG. 3 is an example illustration of a flowchart outlining the operation of a coder according to one embodiment.

FIG. 3 is an example illustration of a flowchart 300 outlining the operation of the coder 100 according to one embodiment. The flowchart 300 illustrates a method that can include the embodiments disclosed above.

At 310, a target vector $x_2$ can be generated from a received input signal s(n). The input signal s(n) can be based on an audible speech input signal. At 320, a plurality of inverse weighting functions $f(x_2,i)$ can be constructed based on the target vector $x_2$. Optionally, a plurality of candidate code-vectors $c_k^{[i]}$ can also be constructed based on the target vector $x_2$ and inverse weighting functions $f(x_2,i)$. The plurality of inverse weighting functions $f(x_2,i)$ (and/or plurality of candidate code-vectors $c_k^{[i]}$) can be constructed based on an inverse filtered vector and based on a backward filtered vector along with the target vector $x_2$. The plurality of inverse weighting functions $f(x_2,i)$ (and/or plurality of candidate code-vectors $c_k^{[i]}$) can also be constructed based on a sum of a weighted inverse filtered vector and a weighted backward filtered vector along with the target vector $x_2$.

At 330, an error value $\epsilon$ associated with each code-vector of the plurality of inverse weighting functions $f(x_2,i)$ (and/or plurality of candidate code-vectors $c_k^{[i]}$) can be evaluated to produce a fixed codebook code-vector $c_k$. For example, errors $\epsilon[i]$ of $c_k^{[i]}$ can be evaluated to produce $c_k^{[i^*]}$, then $c_k^{[i^*]}$ can be used as a basis for further searching on $c_k$. Note that the value k can be the ultimate codebook index that is output.

At 340, a codeword k representative of the fixed codebook code-vector $c_k$ can be generated, where the codeword can be used by a decoder to generate an approximation $\hat{s}(n)$ of the input signal s(n). At 350, the codeword k can be output. For example, the codeword k can be a fixed codebook index parameter codeword k that can be output by transmitting the fixed codebook index parameter k and/or storing the fixed codebook index parameter k.

Figure 4:
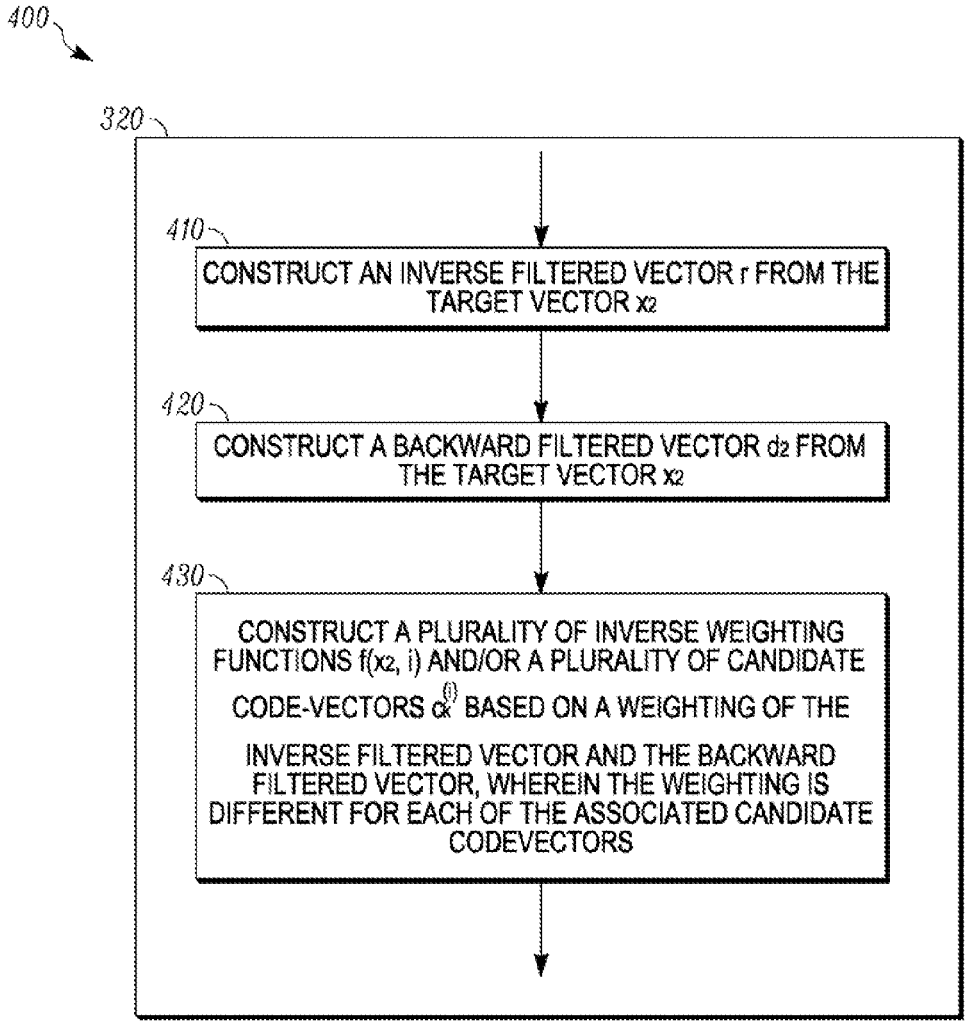
FIG. 4 is an example illustration of a flowchart outlining candidate code-vector construction operation of a coder according to one embodiment.

FIG. 4 is an example illustration of a flowchart 400 outlining the operation of block 320 of FIG. 3 according to one embodiment. At 410, an inverse filtered vector r can be constructed from the target vector $x_2$. The inverse weighting function $f(x_2, i)$ of block 320 can be based on the inverse filtered vector r constructed from the target vector $x_2$. The inverse filtered vector r can be constructed based on $r=H^{-1}x_2$, where r can be the inverse filtered vector, where $H^{-1}$ can be a zero-state weighted synthesis convolution matrix formed from an impulse response of a weighted synthesis filter, and where $x_2$ can be the target vector. Other variations are described in other embodiments above.

At 420, a backward filtered vector $d_2$ can be constructed from the target vector $x_2$. The inverse weighting function $f(x_2, i)$ of block 320 can be based on the backward filtered vector $d_2$ constructed from the target vector $x_2$. The backward filtered vector $d_2$ can be constructed based on $d_2=H^T x_2$, where $d_2$ can be the backward filtered vector, where $H^T$ can be a transpose of a zero-state weighted synthesis convolution matrix formed from an impulse response of a weighted synthesis filter, and where $x_2$ can be the target vector. Other variations are described in other embodiments above.

At 430, a plurality of inverse weighting functions $f(x_2,i)$ (and/or plurality of candidate code-vectors $c_k^{[i]}$) can be constructed based on a weighting of the inverse filtered vector r and a weighting of the backward filtered vector $d_2$, where the weighting can be different for each of the associated candidate code-vectors $c_k^{[i]}$. For example, the weighting can be based on $$f(x_2, i) = a_i \frac{r}{\|r\|} + b_i \frac{d_2}{\|d_2\|}$$

or other weighting described above.

Figure 5:
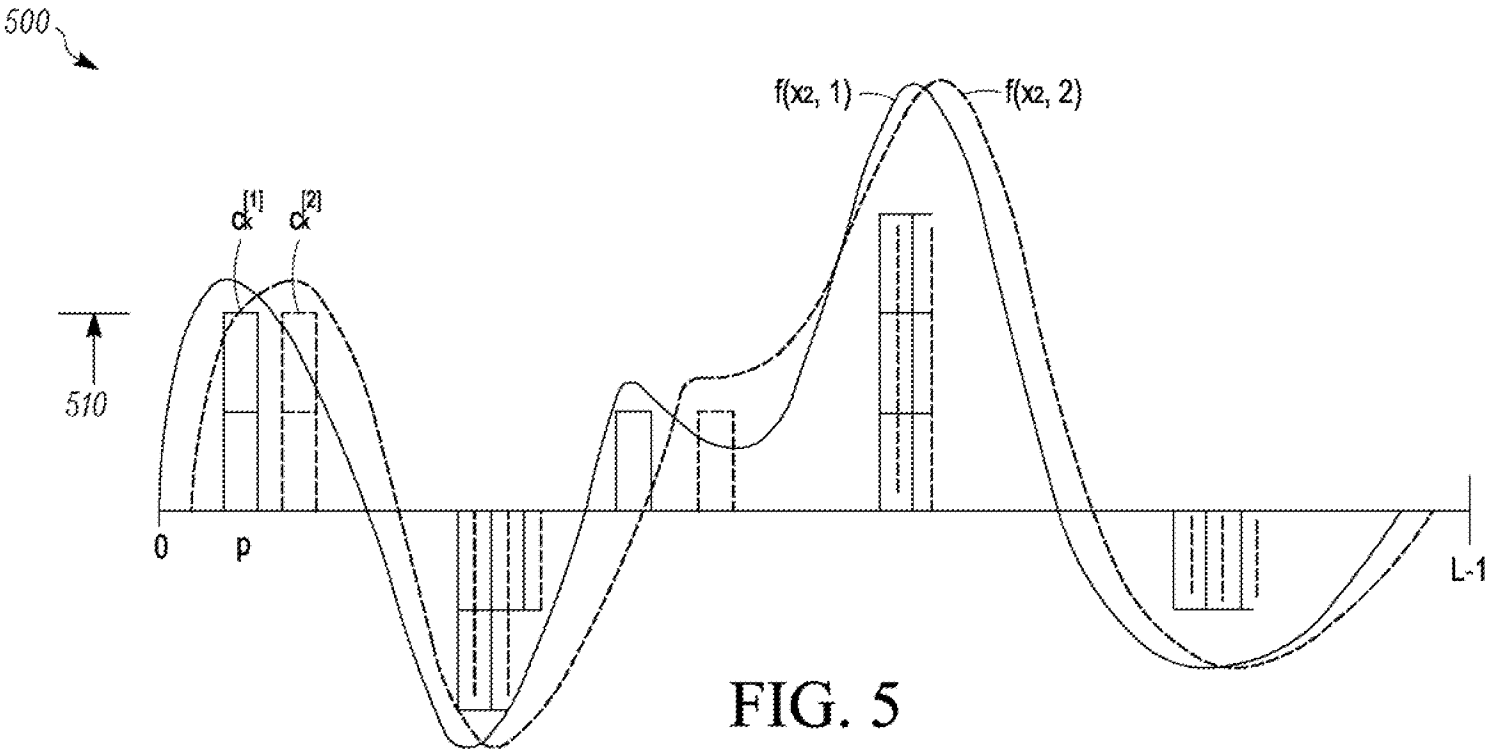
FIG. 5 is an example illustration of two conceptual candidate code-vectors $c_k^{[i]}$ according to one embodiment.

FIG. 5 is an example illustration 500 of two conceptual candidate code-vectors $c_k^{[i]}$ for i=1 and i=2 according to one embodiment. The candidate code-vectors $c_k^{[1]}$ and $c_k^{[2]}$ can correspond to factorial pulse coded vectors for different functions $f(x_2, 1)$ and $f(x_2, 2)$ of a target vector. As discussed above, one of the candidate code-vectors, $c_k^{[i]}$, can be used as a basis for choosing codeword $c_k$ that generates a fixed codebook index parameter k. The fixed codebook index parameter k can identify, at least in part, a set of pulse amplitude and position combinations, such as including a pulse amplitude 510 and a position 520, in a codebook. Each pulse amplitude and position combination can define L different positions and can include both zero-amplitude pulses and non-zero-amplitude pulses assigned to respective positions p=0, 1, 2, . . . L−1 of the combination. The set of pulse amplitude and position combinations can be used for functions $f(x_2, 1)$ and $f(x_2, 2)$ for a chosen candidate code-vector $c_k^{[i^*]}$, such as, for example, code-vector $c_k^{[1]}$. The illustration 500 is only intended as a conceptual example and does not correspond to any actual number of pulses, positions of pulses, code-vectors, or signals.

Figure 6:
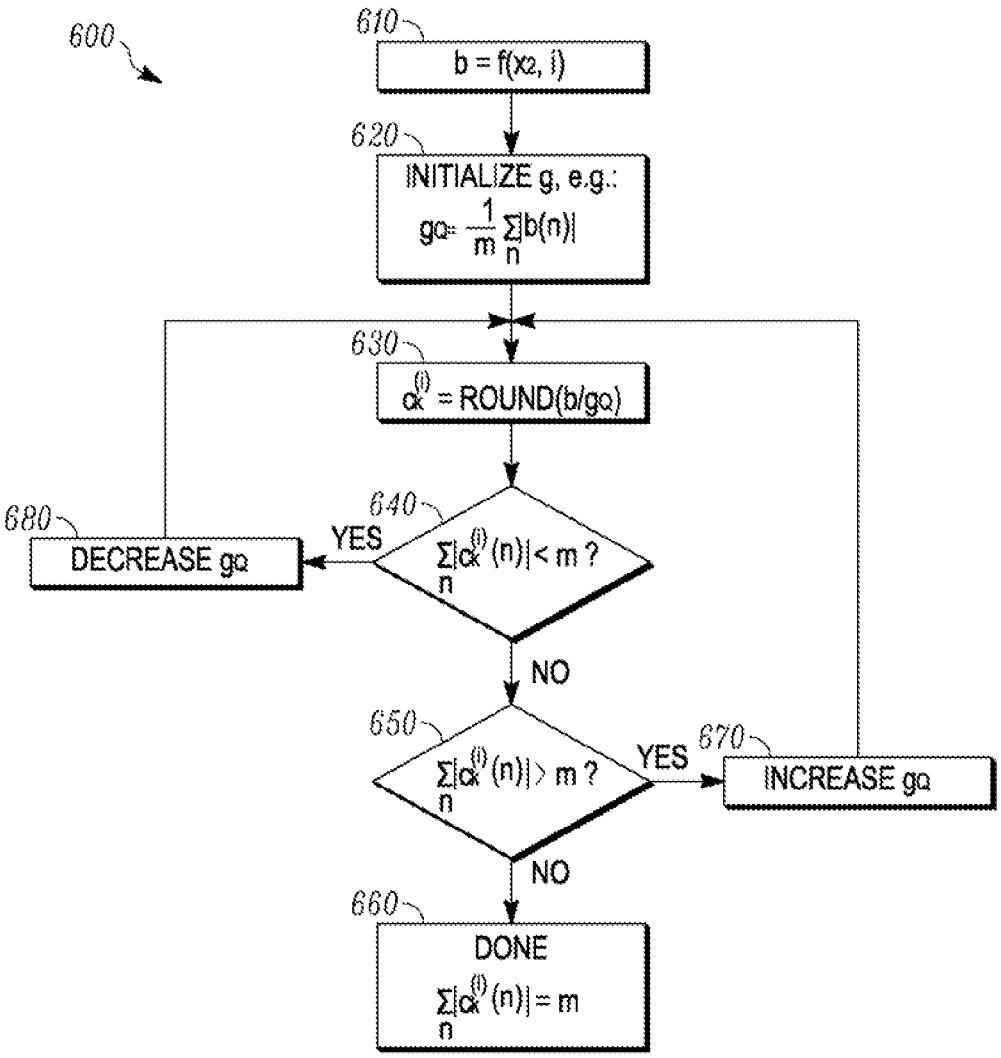
FIG. 6 is an example illustration of a flowchart outlining the operation of a coder according to one embodiment.

FIG. 6 is an example illustration of a flowchart 600 outlining the operation of the coder 100 according to one embodiment. The functions of flowchart 600 may be implemented within the fixed codebook candidate code-vector generator 110. The flowchart 600 illustrates a method that can include the embodiments disclosed above.

At 610, the return value of function $f(x_2,i)$ can be redefined as a residual domain target vector b, where vector b is a different variable from the b, weighting coefficient. At 620, a scalar gain value $g_Q$ can be initialized to some value, and in this case, an estimate can be used based on an average of the vector magnitudes:

$$g_Q = \frac{1}{m}\sum_{n=0}^{L-1} |b(n)| \tag{31}$$

where m can be the total or desired number of unit magnitude pulses, L can be the vector length, and b(n) can be the $n^{th}$ element of the residual domain target vector b. At 630, an iterative search process can begin by which the gain value $g_Q$ can be varied to produce a pre-quantizer candidate $c_k^{[i]}$ that can contain the appropriate number of unit magnitude pulses m, the positions of which correspond to a low residual domain error, i.e., $\|g_Q c_k^{[i]} - b\|^2$ can be a minimum. Given the initialization above, $c_k^{[i]}$ can be generated according to:

$$c_k^{[i]} = \text{round}\left(\frac{b}{g_Q}\right) \tag{32}$$

If it is determined at 640 and 650 that the above operation results in the number of unit amplitude pulses in $c_k^{[i]}$ being m, that is:

$$\sum_n |c_k^{[i]}(n)| = m, \tag{33}$$

then at 660 the process is complete. Otherwise, the gain value $g_Q$ is appropriately altered and the process is repeated. For example, if it is determined at 650 that the result is $$\sum_n |c_k^{[i]}(n)| > m,$$

then $g_Q$ can be increased at 670 so that fewer unit magnitude pulses m are generated when repeating Eq. 32. Likewise, if it is determined at 640 that $$\sum_n |c_k^{[i]}(n)| < m,$$

then $g_Q$ can be decreased at 680 so that fewer unit magnitude pulses m are generated when repeating Eq. 32.

As one may notice, the method described above involves jointly quantizing a plurality of elements within the residual domain target vector b to produce an initial codebook candidate vector $c_k^{[i]}$ through an iterative search process. The functions of flowchart 700 may be implemented within the fixed codebook candidate code-vector generator 110, and this flowchart 700 may occur after the flowchart 400 of FIG. 4.

Many other ways of determining an initial codebook candidate value $c_k^{[i]}$ from the residual domain target vector $b=f(x_2,i)$ exist. For example, a median search based quantization method may be employed that may be more efficient. This can be an iterative process involving finding an optimum pulse configuration satisfying the pulse sum constraint for a given gain and then finding an optimum gain for the optimum pulse configuration. A practical example of such a median search based quantization is given in ITU-T Recommendation G.718 entitled "Frame error robust narrow-band and wide-band embedded variable bit-rate coding of speech and audio from 8-32 kbit/s", section 6.11.6.2.4, pp. 153, which is hereby incorporated by reference.

Figure 7:
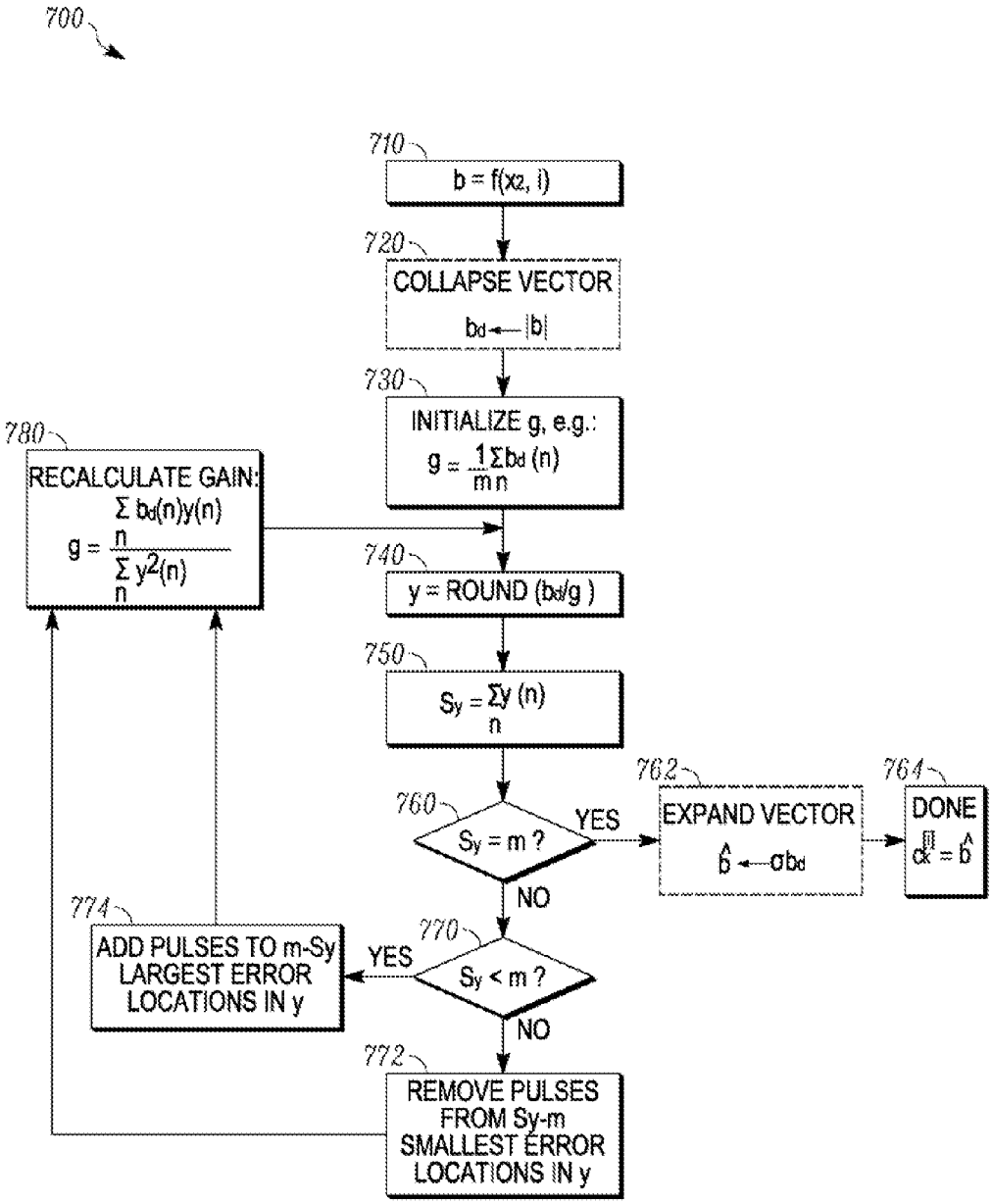
FIG. 7 is an example illustration of a flowchart outlining the operation of a coder according to one embodiment.

FIG. 7 is an example illustration of a flowchart 700 outlining the operation of the coder 100 according to one embodiment. This method of the flowchart 700 can tend to minimize the residual domain error $\|g\hat{b} - b\|^2$. This flowchart 700 may occur after the flowchart 400 of FIG. 4. In this embodiment, a median based Vector Quantization (VQ) search process is used to obtain the output vector $c_k^{[i]}=\hat{b}$ from the residual domain target vector $b=f(x_2,i)$ from 710. The main parameter for the search is the sum of pulse magnitudes m. If m<L, a maximum of m out of the L locations of the output vector $\hat{b}$ will be non-zero. Moreover, if the length of the vector b is significantly greater than the sum of pulse magnitudes m, the VQ search technique may be performed on a "collapsed" vector $b_d$ from 720, where $b_d$ can correspond to the largest of the m absolute values of b. For example, from FIG. 5, the vector $b=f(x_2, i)$ can be collapsed to the eleven (m=11) elements which have a magnitude component large enough to contain a pulse. So let $m_d$ be the $m^{th}$ largest value of |b|, i.e., there are m elements in |b| such that $|b(n)| \geq m_d$. The vector $$b_d = \{|b(n)| : |b(n)| \geq m_d, b(n) \in b\} \tag{34}$$

is therefore an m-dimensional vector whose elements are the m largest magnitude elements of vector b. The index and signs of components of b which form $b_d$ are stored as $I_b$ and $\sigma_b$. Otherwise, the vector may simply be defined as:

$$b_d=|b|, \tag{35}$$

where the signs of b may be stored in $\sigma_b$.

At 730, the initial gain g for finding the optimum vector may be given by:

$$g=\frac{1}{m}\sum_{n=0}^{m-1} b_d(n) \tag{36}$$

where $b_d$ (n) can be the $n^{th}$ element of vector $b_d$. At 740, to obtain the optimum vector satisfying the Factorial Pulse Coding (FPC) constraint (i.e., the sum of integral valued pulse magnitudes within a vector is a constant), for a given gain g, first an intermediate output vector y given by $$y(n)=\text{round}\left(\frac{b_d(n)}{g}\right), \quad 0\le n<m, \tag{37}$$

is obtained. The resulting vector y may or may not satisfy the FPC constraint. At 750, to ensure that the FPC constraint is satisfied, the following definition is made:

$$S_y=\sum_{n=0}^{m-1} y(n) \tag{38}$$

At 760, if the definition results in $S_y$=m, then the VQ search process may optionally expand the vector at 762 and can finish at 764 with a pre-quantizer candidate $c_k^{i*}$.

If $S_y\neq$m, then an error vector can be generated of the form:

$$E_y=b_d-gy. \tag{39}$$

At 770, depending on whether $S_y$ is greater than or less than m, the intermediate vector is modified to generate a vector satisfying the FPC constraint. For example, if $S_y$ is greater than m, then at 772 $S_y$−m pulses in y can be removed. The locations j of pulses which are to be removed can be identified as $$j=\{n:e_y(n)\le \text{median}_l(E_y,S_y-m)\}, \tag{40}$$

where $E_y=\{e_y(0), e_y(1), \ldots, e_y(m-1)\}$. One pulse is removed from y at each of the above locations, which correspond to the locations of the $S_y$−m smallest error values. While removing a pulse at a location j, it is made sure that $y_j$ is non-zero at that location; otherwise the magnitude of the next smallest error location may be reduced.

If, on the other hand, $S_y$<m, then, at 774, m−$S_y$ pulses can be added to y. The location of these pulses can be obtained as:

$$j=\{n:e_y(n)\ge \text{median}_h(E_y,m-S_y)\}, \tag{41}$$

which can correspond to the locations of the m−$S_y$ largest error values. The modification steps can ensure that the FPC constraint is satisfied for vector y. At 780, the optimum gain g for vector y can be recomputed as:

$$g=\frac{\sum_{n=0}^{m-1} b_d(n)y(n)}{\sum_{n=0}^{m-1} y^2(n)}. \tag{42}$$

and the steps 740 and 750 can be repeated. After $S_y$=m, at 764, the intermediate output vector y can then be used to form the L dimension output vector $c_k^{[i]}=1$; by remapping y using the indexes $I_b$ and signs $\sigma_b$. That is:

$$\hat{b}(j)=\begin{cases}\sigma_b(j)y(i); & j\in I_b,\ i\in\{0,\ldots,m-1\}\\ 0; & \text{otherwise,}\end{cases} \quad 0\le j<L. \tag{43}$$

In the case where the number of pulses m is not significantly more than the vector length L, the above expression may simply be:

$$\hat{b}(j)=\sigma_b(j)y(j);0\le j<L \tag{44}$$

Figure 8:
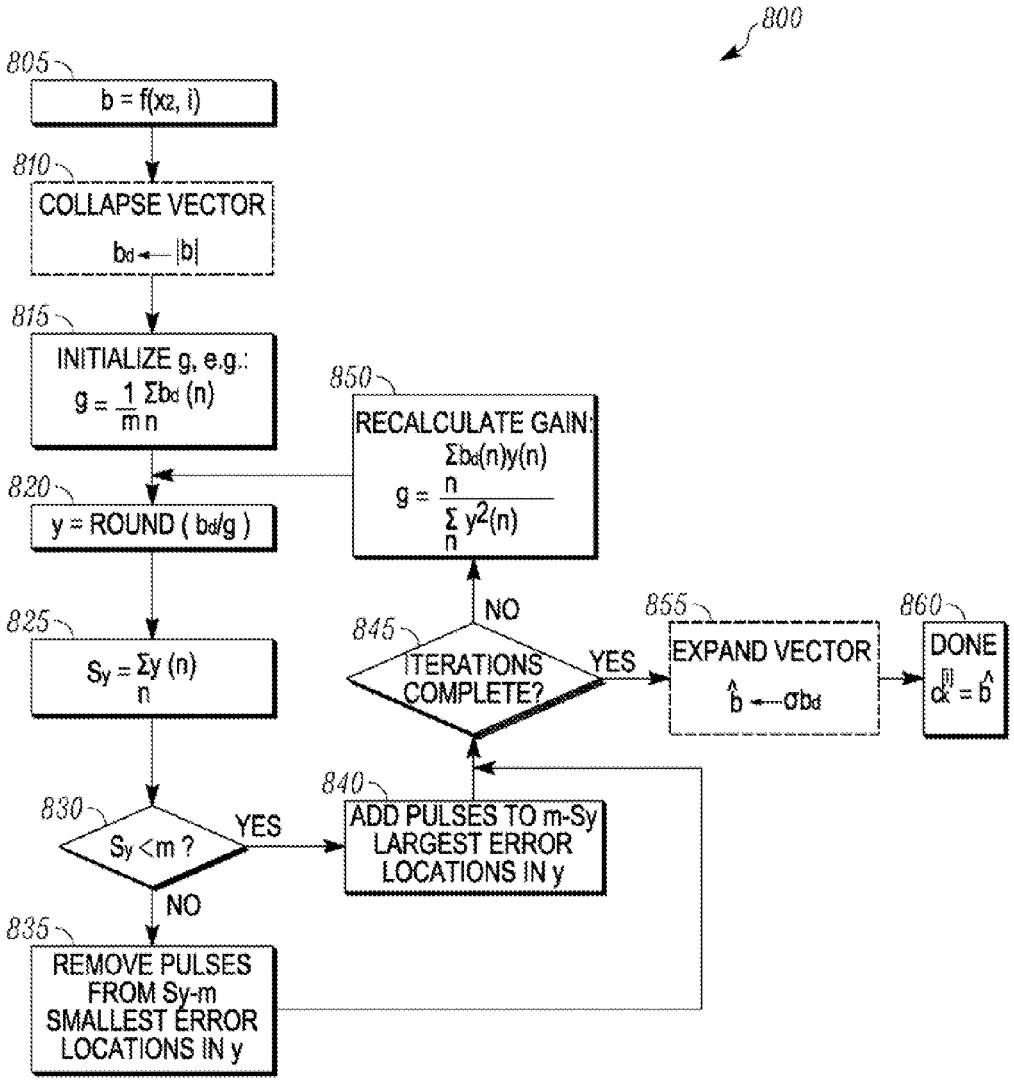
FIG. 8 is an example illustration of a flowchart outlining the operation of a coder according to one embodiment.

FIG. 8 is an example illustration of a flowchart 800 outlining the operation of the coder 100 according to one embodiment. Instead of stopping when $S_y$=m per FIG. 7 step 760, FIG. 8 iterates pulse repositioning until a predetermined condition is met. For example, the search process may be terminated after a predetermined number of iterations have been performed. As above, this method can tend to minimize the residual domain error $\|g\hat{b}-b\|^2$. In this embodiment, a median based Vector Quantization (VQ) search process is used to obtain the output vector $c_k^{[i]}=\hat{b}$ from the residual domain target vector $b=f(x_2,i)$ from 805. The main parameter for the search can be the sum of pulse magnitudes m. If m<L, a maximum of m out of the L locations of the output vector $\hat{b}$ will be non-zero. Moreover, if the length of the vector L is significantly greater than the sum of pulse magnitudes m, the VQ search technique may be performed on a "collapsed" vector $b_d$ from 810, where $b_d$ can correspond to the largest of the m absolute values of b, such as described with respect to element 720 in FIG. 7.

In the subsequent description, $\text{median}_h(E, k)$ and $\text{median}_l(E, k)$ can refer to the $k^{th}$ higher and $k^{th}$ lower median of vector E, respectively, that is:

$$\text{median}_h(E,k)=\max(m_d):\aleph(\{e(n):e(n)\ge m_d,e(n)\in E\})=k \tag{45}$$

and $$\text{median}_l(E,k)=\min(m_d):\aleph(\{e(n):e(n)\le m_d,e(n)\in E\})=k \tag{46}$$

where $\aleph$ is a cardinality operator which counts the number of elements in a set.

Using this definition of the $k^{th}$ high and low median values of a given set E, the following iterative process can involve finding an optimum pulse configuration satisfying the FPC constraint for a given gain, and then finding the optimum gain for the optimum pulse configuration. As in the example above, this method also tends to minimize the residual domain error $\|g\hat{b}-b\|^2$. At 815, the initial gain g for finding the optimum vector b may be given by Eq. 36:

$$g=\frac{1}{m}\sum_{n=0}^{m-1} b_d(n) \tag{47}$$

where $b_b(n)$ is the $n^{th}$ element of vector $b_d$.

To obtain the optimum vector satisfying the FPC constraint (i.e., the sum of integral valued pulse magnitudes within a vector is a constant) for a given gain g, first at 820, an intermediate output vector y is obtained according to Eq. 37:

$$y(n) = \text{round}\left(\frac{b_d(n)}{g}\right), \quad 0 \le n < m. \tag{48}$$

The resulting vector y may or may not satisfy FPC constraint. To ensure that the FPC constraint is satisfied, at 825 the following definition is made per Eq. 38:

$$S_y = \sum_{n=0}^{m-1} y(n) \tag{49}$$

and the following error vector is generated of the form of Eq. 39:

$$E_y = b_d - gy \tag{50}$$

Now depending on whether $S_y$ is greater than or equal to or less than m at 830, the intermediate vector is modified to generate a vector satisfying the FPC constraint. If $S_y \ge m$, then $S_y - m$ pulses in Y are removed at 835. The locations j of pulses which are to be removed are identified from Eq. 40 as $$j = \{n : e_y(n) \le \text{median}_l(E_y, S_y - m)\}, \tag{51}$$

where $E_y = \{e_y(0), e_y(1), \ldots, e_y(m-1)\}$. One pulse can be removed from y at each of the above locations, which correspond to the locations of the $S_y - m$ smallest error values. While removing a pulse at a location j, it is made sure that $y_j$ is non-zero at that location, otherwise the magnitude of the next smallest error location may be reduced. If, on the other hand, $S_y < m$, then $m - S_y$ pulses can be added to y at 840. The location of these pulses can be obtained from Eq. 41 as:

$$j = \{n : e_y(n) \ge \text{median}_h(E_y, m - S_y)\}, \tag{52}$$

which correspond to the locations of the $m - S_y$ largest error values. The modification steps ensure that the FPC constraint is satisfied for vector y.

If the iterations are not complete at 845, at 850, the optimum gain g for vector y can be recomputed per Eq. 42 as:

$$g = \frac{\sum_{n=0}^{m-1} b_d(n) y(n)}{\sum_{n=0}^{m-1} y^2(n)}. \tag{53}$$

and the steps 820 and 825 are repeated. In an unlikely event that after a predetermined number of iterations through 845, the output vector y does not satisfy the FPC constraint, then the vector y may be further modified by adding or removing pulses. The location of the pulses which are to be added or removed can be identified by:

$$j = \{n : e_y(n) = m_l\}, \tag{54}$$

where vector $E_y$ is calculated in Eq. 50 and $m_l$ is the lower median calculated in Eq. 46. The vector b can be optionally expanded at 855. At 860, the intermediate output vector can then be used to form the L dimension output vector $c_k^{[i]} = \hat{b}$ by remapping y using the indexes $I_b$ and signs $\sigma_b$. That is, like Eq. 43:

$$\hat{b}(j) = \begin{cases} \sigma_b(j) y(i); & j \in I_b,\ i \in \{0, \ldots, m-1\} \\ 0; & \text{otherwise} \end{cases}, \quad 0 \le j < L. \tag{55}$$

In the case where the number of pulses m is not significantly more than the vector length L, the above expression may simply be like Eq. 44:

$$\hat{b}(j) = \sigma_b(j) y(j); 0 \le j < L. \tag{56}$$

It should be noted that while the median based VQ search can be based on a very efficient search methodology, other methods are possible. For example, in the above procedure, it may be possible to employ a brute force method for finding the largest or smallest elements of the error vector $E_y$ that may not have the same computational complexity benefits as the median based VQ search; however, the end result may be identical or nearly identical in terms of performance. In addition, the search methods in FIG. 7 and FIG. 8 may be combined to improve overall efficiency. For example, the termination test step 760 may be placed between steps 825 and 830, and then coupled to block 855 in the event that the search has converged ($S_y = m$). This allows complexity to be limited through fixed means (block 845), or by convergence to the optimum number of pulses per 760 of FIG. 7.

Moving on, the N different pre-quantizer candidates may be evaluated according to the following expression (which is based on Eq. 17):

$$i^* = \underset{0 \le i < N}{\text{argmax}} \left\{ \frac{(d_2^T c_k^{[i]})^2}{c_k^{[i]T} \Phi c_k^{[i]}} \right\}, \tag{57}$$

where $c_k^{[i]}$ can be substituted for $c_k$, and the best candidate i* out of N candidates can be selected. Alternatively, I may be determined through brute force computation:

$$i^* = \underset{0 \le i < N}{\text{argmax}} \left\{ \frac{(x_2^T y_2^{[i]})^2}{y_2^{[i]T} y_2^{[i]}} \right\}, \tag{58}$$

where $y_2^{[i]} = Hc_k^{[i]}$ and can be the i-th pre-quantizer candidate filtered though the zero state weighted synthesis filter 105. The latter method may be used for complexity reasons, especially when the number of non-zero positions in the pre-quantizer candidate, $c_k^{[i]}$, is relatively high or when the different pre-quantizer candidates have very different pulse locations. In those cases, the efficient search techniques described in the prior art do not necessarily hold. The two methods given in Eqs. 57 and 58, however, are equivalent.

After the best pre-quantizer candidate $c_k^{[i^*]}$ is selected, a post-search may be conducted to refine the pulse positions, and/or the signs, so that the overall weighted error is reduced further. The post-search may be one described by Eq. 57. In this case, the numerator and denominator of Eq. 57 may be initialized by letting $c_k = c_k^{[i^*]}$, and then iterating on k to reduce the weighted error. This is described in more detail below.

After $c_k$ is initialized, a new error metric $\epsilon$ can be defined based on Eq. 17 as:

$$\varepsilon = \frac{(d_2^T c_k)^2}{c_k^T \Phi c_k}, \tag{59}$$

which can be maximized (per Eq. 17) to find a low error value. During the post-search, $c_k$ can be iterated by defining a vector containing a single pulse $c_m$ that is subtracted from $c_k$, and defining another vector $c_p$ containing a single pulse that is added back in at a different location. This can be expressed as $c'_k=c_k-c_m+c_p$. If this expression is plugged into Eq. 59, a second error metric $\epsilon'$ can be defined as:

$$\begin{aligned}\varepsilon' &= \frac{(d_2^T c'_k)^2}{c_k'^T \Phi c'_k} \\ &= \frac{(d_2^T (c_k - c_m + c_p))^2}{(c_k - c_m + c_p)^T \Phi (c_k - c_m + c_p)}.\end{aligned} \tag{60}$$

Figure 9:
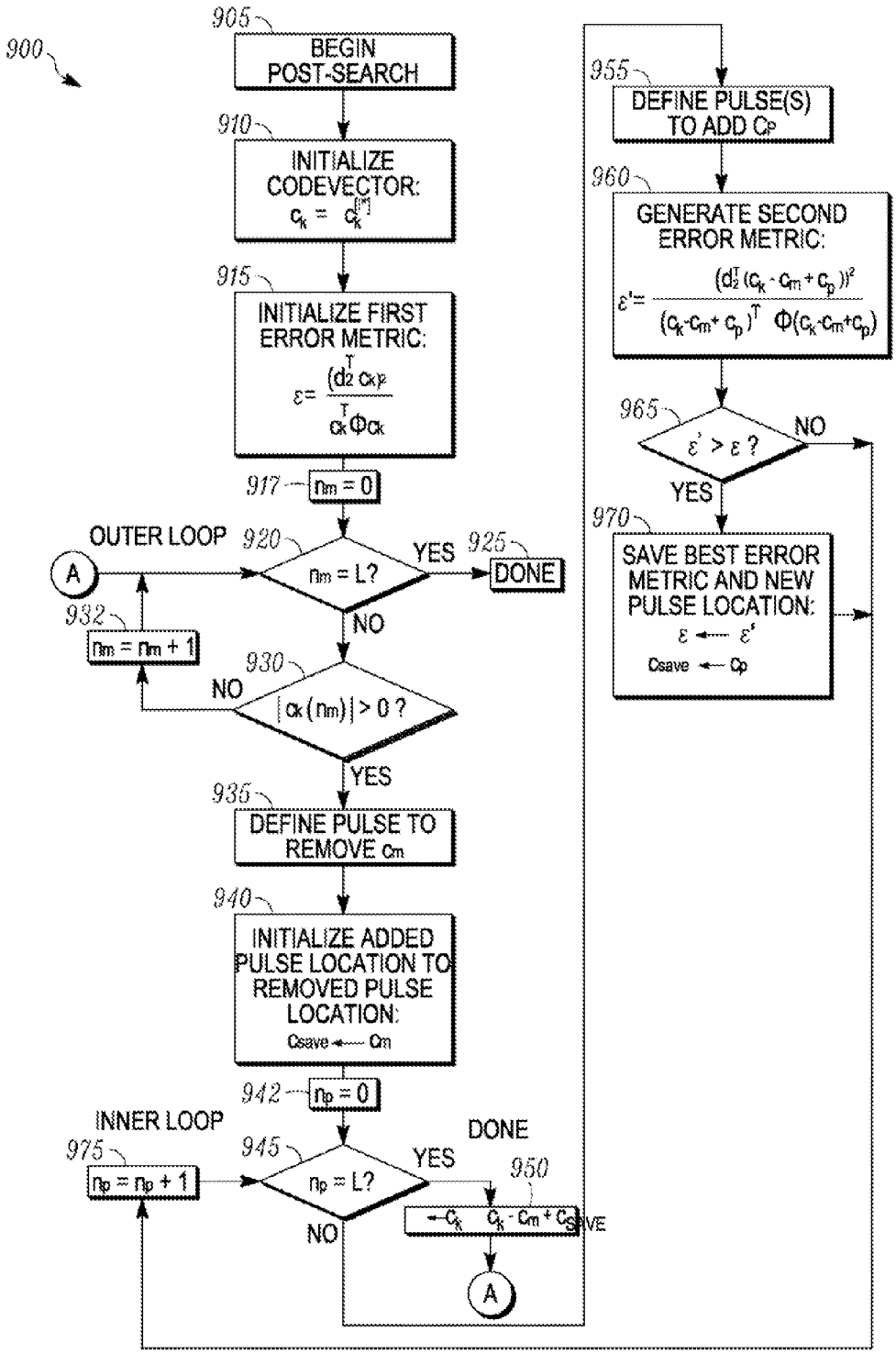
FIG. 9 is an example illustration of a flowchart outlining the operation of a coder according to one embodiment.

FIG. 9 is an example illustration of a flowchart 900 outlining the operation of the coder 100 according to one embodiment. The functions of flowchart 900 may be implemented within the FCB loop of FIG. 1 (i.e., fixed codebook 104, zero state weighted synthesis H equivalent 105, weighting block 141, combiner 108, error minimization block 107, and output 126). The flowchart 900 shows one example of a post-search strategy that uses the above idea. For example, a pulse at each position $n_m$ can be removed one at a time, replaced by a single pulse at a time, over all possible positions $0 \le n_p < L$, and evaluated for a low error value. At 905, the post-search strategy begins. At 910, the code-vector $c_k$ is initialized by letting $c_k=c_k^{[i*]}$. At 915, the error metric $\epsilon$ is initialized according to Eq. 59. The first (i.e., "outer") loop is then initialized, which controls the pulses that are effectively removed from code-vector $c_k$. For example, the outer loop can run through $n_m$ positions from zero to L−1 in the code-vector $c_k$. At 917, $n_m$ can be set to zero. At 920, the method can determine whether the last position L−1 has been processed. If it has, at 925, the post-search can finish. If the last position L−1 has not been processed, at 930, the method can check whether or not a pulse exists in code-vector $c_k$ at position $n_m$. If a pulse does not exist at position $n_m$, then the position $n_m$ is incremented through 920 until a non-zero position in code-vector $c_k$ is found at 930. If a non-zero position is found, $n_m$ can be incremented at 932 and the process can continue at 920.

After a non-zero position is found, the vector $c_m$ can be formed, which can be defined at 935 as:

$$c_m(n) = \begin{cases} \mathrm{sgn}(c_k(n)); & n = n_m \\ 0; & \text{otherwise} \end{cases}, \quad 0 \le n < L, \tag{61}$$

where $\mathrm{sgn}(c_k(n))$ can be the signum function (+1 or −1) of the respective vector element of code-vector $c_k$. At 940, the method can use vector $c_m$ to initialize the value of the "addition vector" $c_{save}$, which will be discussed next. The second ("inner") loop is then started, which is used to determine if a particular pulse (defined by $c_m$) may be used somewhere else more effectively to reduce the overall error value. As such, the pulse is added by way of vector $c_m$. The outer loop can run through $n_p$ positions from zero to L−1 in the code-vector $c_k$. At 917, $n_p$ can be set to zero. At 945, the method can determine whether the last position L−1 has been processed. If it has, at 950, all positions have been exhausted, and the new best code-vector $c_k$ is updated as $c_k \leftarrow c_k-c_m+c_{save}$ and the method can return to 920. If the last position L−1 has not been processed, at 955, the method can define the pulses $c_p$ to add to vector $c_m$ as:

$$c_p(n) = \begin{cases} \mathrm{sgn}(c_k(n)); & n = n_p \\ 0; & \text{otherwise} \end{cases}, \quad 0 \le n < L, \tag{62}$$

where $n_p$ can be the position defined by the inner loop. At 960, the second error metric $\epsilon'$ can be calculated for the modified code-vector $c'_k=c_k-c_m+c_p$ according to Eq. 60. At 965, if the second error metric produces a better result than the original, i.e., $\epsilon'>\epsilon$, then at 970 the new "best" error metric is saved, along with the new "best" position vector $c_{save}$, such as the pulse location $c_p$. At 975, $n_p$ can be incremented.

Again, at 950, all positions have been exhausted, then the new best code-vector $c_k$ is updated as $c_k \leftarrow c_k-c_m+c_{save}$. In the case where no new "best" position vector is generated, then the proper initialization of $c_{save}=c_m$ guarantees that code-vector $c_k$ will be unmodified. At 920, the process is then repeated for all iterations defined by the outer loop, e.g., $0 \le n_m < L$.

As one skilled in the art may observe, the above example may be computationally prohibitive on a modern signal processing device because of, among other things, the presence of Eq. 60 in the innermost loop at step 960. As such, the example of the flowchart 900 is intended for illustrative purposes only. A computationally feasible, yet equivalent, example of this process is now described. Referring back to Eq. 60, the terms of this expression can be expanded as:

$$\varepsilon' = \frac{(d_2^T c_k - d_2^T c_m + d_2^T c_p)^2}{c_k^T \Phi c_k + c_m^T \Phi c_m - 2c_k^T \Phi c_m + c_p^T \Phi c_p - 2c_m^T \Phi c_p + 2c_k^T \Phi c_p}. \tag{63}$$

As defined for this example, since $c_m$ and $c_p$ contain only one unit magnitude pulse each, then Eq. 63 can be rewritten as:

$$\varepsilon' = \frac{(d_2^T c_k - d_2(n_m) + d_2(n_p))^2}{c_k^T \Phi c_k + \phi(n_m, n_m) - 2c_k^T \Phi(n_m) + \phi(n_p, n_p) - 2\phi(n_m, n_p) + 2c_k^T \Phi(n_p)} \tag{64}$$

where $n_p$ and $n_m$ are the positions of the single pulses within $c_p$ and $c_m$, respectively, and where $\Phi(n_p)$ and $\Phi(n_m)$ are the respective $n_p$ and $n_m$-th column vectors of the correlation matrix $\Phi$. (Recall from the Background that $\Phi=H^T H$, which supports the zero state weighted synthesis H equivalency.) Now looking at where in the process each of the terms can be generated, the following expression, after some rearrangement of terms, shows how most of terms in the inner loop have relatively low complexity, using just a few scalar operations:

$$\varepsilon' = \frac{\left(\underbrace{d_2^T c_k}_{Initialization} - \underbrace{d_2(n_m)}_{OuterLoop} + \underbrace{d_2(n_p)}_{InnerLoop}\right)^2}{\underbrace{c_k^T \Phi c_k}_{Initialization} - \underbrace{2c_k^T \Phi(n_m) + \phi(n_m, n_m)}_{OuterLoop} + \underbrace{2c_k^T \Phi(n_p) + \phi(n_p, n_p) - 2\phi(n_m, n_p)}_{InnerLoop}}. \tag{65}$$

However, both the inner and outer loops still contain vector terms in the denominator. As another example, these terms can be pre-computed and stored in arrays, and then updated as code-vector $c_k$ evolves. For example, a temporary storage vector s can be defined as:

$$s(n)=2c_k^T \Phi(n), 0 \le n < L, \tag{66}$$

which can then be indexed (as a lookup table) during the inner/outer loop processing. This can then be applied to Eq. 65 to yield:

$$\varepsilon' = \frac{\left(\underbrace{\frac{d_2^T c_k}{}}_{Initialization} - \underbrace{\frac{d_2(n_m)}{}}_{OuterLoop} + \underbrace{\frac{d_2(n_p)}{}}_{InnerLoop}\right)^2}{\underbrace{c_k^T \Phi c_k}_{Initialization} - \underbrace{s(n_m) + \phi(n_m, n_m)}_{OuterLoop} + \underbrace{s(n_p) + \phi(n_p, n_p) - 2\phi(n_m, n_p)}_{InnerLoop}}, \quad (67)$$

which now reduces all inner/outer loop to scalar operations involving indexing of pre-computed vector/matrix quantities.

For the embodiments above, it can seen that the computational complexity of the combined pre-quantizer candidate search followed by the post-search can be significantly lower than a brute force exhaustive search over all possible codebook code-vectors. For example, if an FPC codebook (from Peng) is used, and is given to be 20 pulses spread over 64 positions, then the total number of pulse combinations would be $6.56\times10^{23}$. This number of combinations is impractical to search using any known hardware in a real-time system. However, near optimal performance can be achieved by a combination of the pre-quantizer candidate search and the example post search, which can move some or all of the 20 pulses across each of the 64 positions after the pre-quantizer candidate $c_k^{i*}$ is determined. When using the disclosed method, only a small number (for example, 20×64=1280) of search iterations defined by Eq. 65 may be required to obtain near optimal performance. Furthermore, as previously noted, all grouping of independent variables can be pre-computed outside of the innermost computation loops, so that overall complexity can be held very low.

Figure 10:
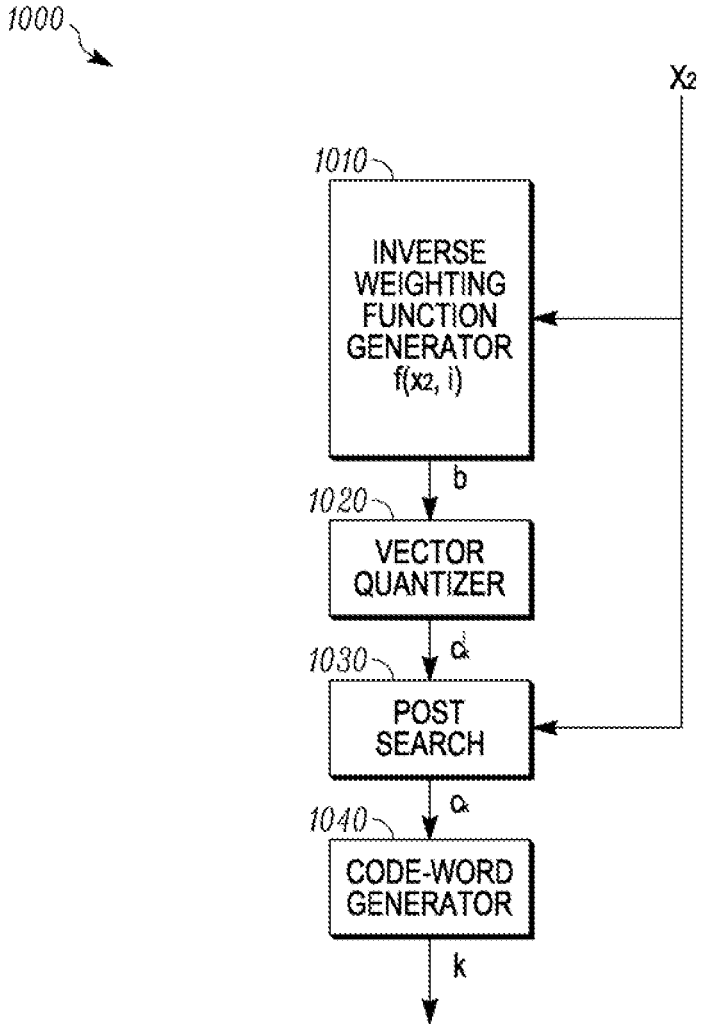
FIG. 10 is an example block diagram of the fixed codebook candidate code-vector generator from FIG. 1 according to one embodiment.

FIG. 10 is an example block diagram of a fixed codebook code-vector generator 1000, which may be implemented within the fixed codebook candidate code-vector generator 110 from FIG. 1, according to one embodiment. The fixed codebook candidate code-vector generator 1000 can perform the operations of the methods disclosed above with respect to FIGS. 6, 7, 8, and 9. The fixed codebook candidate code-vector generator 1000 can include an inverse weighting function generator 1010, a vector quantizer 1020, a post search 1030, and a codeword generator 1040.

The fixed codebook code-vector generator 1000 can produce a final fixed codebook code-vector $c_k$ based on a code-vector $c_k^{i*}$ from a set of candidate code-vectors $c_k^{[i]}$. The fixed codebook code-vector generator 1000 can construct the set of candidate code-vectors $c_k^{[i]}$, where i can be an index for the candidate code-vectors $c_k^{[i]}$. The set of candidate code-vectors $c_k^{[i]}$ can be based on a weighted target vector $x_2$ and can be based on an inverse weighting function, such as $f(x_2,i)$.

For example, the fixed codebook code-vector generator 1000 can process the weighted target vector $x_2$ through an inverse weighting function $f(x_2, i)$ to create a residual domain target vector b. According to one embodiment, the inverse weighting function generator 1010 can process the weighted target vector $x_2$ through the inverse weighting function $f(x_2, i)$ to create the residual domain target vector b. The fixed codebook code-vector generator 1000 can obtain the inverse weighting function $f(x_2, i)$ based on the weighted target vector $x_2$. The residual domain target vector b may not truly be or may not only be in the residual domain as the inverse weighting function $f(x_2, i)$ may include different features. For example, the residual domain target vector b may be an inverse weighting result, a pitch removed residual target vector, or any other target vector that results from the inverse weighting function $f(x_2, i)$.

The fixed codebook code-vector generator 1000, which may be implemented in the fixed codebook candidate code-vector generator 110 of the coder 100, can use the vector quantizer 1020 to perform a first search process on the residual domain target vector b to obtain an initial fixed codebook code-vector $c_k^i$. The fixed codebook candidate code-vector $c_k^i$ can have a pre-determined number of unit magnitude pulses m per FIGS. 6 and 7. The fixed codebook code-vector generator 1000 can perform the first search process on the residual domain target vector b for a low residual domain error to obtain the initial fixed codebook code-vector $c_k^i$. The coder 100 can perform the first search process by vector quantizing the residual domain target vector b to obtain the initial fixed codebook code-vector $c_k^i$, where the initial fixed codebook code-vector $c_k^i$ can include a pre-determined number m of unit magnitude pulses. The coder 100 can perform a first search process, or vector quantize, the residual domain target vector b according to the processes illustrated in flowcharts 600, 700, or 800 and according to other processes disclosed in the above embodiments.

For example, the fixed codebook code-vector generator 1000 can vector quantize the residual domain target vector, or otherwise search to obtain an initial fixed codebook candidate code-vector $c_k^{i*}$, where the quantization error can be evaluated in the residual domain. The initial fixed codebook candidate code-vector $c_k^{i*}$can include a pre-determined number of unit magnitude pulses m. For example, the vector quantizer 1020 can vector quantize the residual domain target vector b to obtain the initial fixed codebook code-vector $c_k^{i*}$. The vector quantizer 1020 can use the methods illustrated in the flowcharts 600, 700, and 800 and other methods to vector quantize the residual domain target vector b. Vector quantizing can include jointly quantizing two or more elements of the residual domain target vector b to obtain the initial fixed codebook code-vector $c_k^i$. Vector quantization or the first search can include rounding a gain term applied to vector elements of the inverse weighting function to select a gain term such that a total number of unit amplitude pulses in the fixed codebook code-vector can equal a given number. Vector quantization or the first search can include performing a median search quantization including finding an optimum pulse configuration satisfying a pulse sum constraint for a given gain and finding an optimum gain for the optimum pulse configuration. Vector quantization or the first search can include using a factorial pulse coded codebook to determine the fixed codebook code-vector. Vector quantization or the first search can also include any other method of vector quantization.

The fixed codebook code-vector generator 1000 can use the post search 1030 implementing flowchart 900 to perform a second search process over a subset of possible codebook code-vectors for a low weighted-domain error to produce a final fixed codebook code-vector $c_k$. The final fixed codebook code-vector $c_k$ can have a different number of pulses than the initial fixed codebook code-vector $c_k^i$. The subset of possible codebook code-vectors can be based on the initial fixed codebook code-vector $c_k^i$. The fixed codebook code-vector generator 1000 can perform the second search process by iterating the initial fixed codebook code-vector $c_k^i$ through a zero state weighted synthesis filter equivalent 105 using a fixed codebook a plurality of times and by evaluating at least one error value associated with each iteration of the initial fixed codebook code-vector $c_k^i$ from the plurality of times to produce a final fixed codebook code-vector $c_k$ based on an initial fixed codebook code-vector with a low error value. The second search process can include using a factorial pulse coded codebook to determine the final fixed codebook code-vector $c_k$. The second search process can also include the process illustrated in the flowchart 900 or can include other processes disclosed in the above embodiments.

For example, the fixed codebook code-vector generator 1000 can perform a post search on the fixed codebook candidate code-vector $c_k^i$ to determine a final fixed codebook candidate code-vector $c_k$. The vector quantizer 1020 can perform a first search process on the residual domain target vector b for low residual domain error to obtain an initial fixed codebook code-vector $c_k^i$. The first search process can be based on the processes illustrated in FIGS. 6-8 or based on any other search process that can obtain an initial fixed codebook code-vector. The post search 1030 can perform a second search process, such as the post search process of FIG. 9, over a subset of possible codebook code-vectors for a low weighted-domain error to produce a final fixed codebook code-vector $c_k$. The subset of possible codebook code-vectors can be based on the initial fixed codebook code-vector $c_k^i$. The post search 1030 can determine a final fixed codebook candidate code-vector $c_k$ from the second search process. For example, the second search process can be based on the process illustrated in FIG. 9 or can be based on any other search process that can obtain a final fixed codebook candidate code-vector.

The codeword generator 1040 can generate a codeword k representative of the final fixed codebook code-vector $c_k$. The codeword k can be used by a decoder to generate an approximation $\hat{s}(n)$ of the input signal s(n).

According to a related embodiment, the fixed codebook code-vector generator 1000 can vector quantize the residual domain target vector b to obtain an initial fixed codebook code-vector $c_k^{i*}$. The initial fixed codebook code-vector $c_k^{i*}$ can have a pre-determined number of unit magnitude pulses m. The fixed codebook code-vector generator 1000 can search a subset of possible codebook code-vectors based on the initial fixed codebook code-vector $c_k^{i*}$ for a low weighted-domain error to produce a final fixed codebook code-vector $c_k$. The final fixed codebook code-vector $c_k$ can have a different number of pulses than the initial fixed codebook code-vector $c_k^{i*}$.

As another example, target vector generator 124 of FIG. 1 can produce a weighted target vector $x_2$ from the input signal s(n). The fixed codebook candidate code-vector generator 1000 can process the weighted target vector $x_2$ through an inverse weighting function $f(x_2,i)$ to create a residual domain target vector b. The fixed codebook candidate code-vector generator 1000 can perform a first search process on the residual domain target vector b for a low residual domain error to obtain an initial fixed codebook code-vector $c_k^{i*}$. The fixed codebook candidate code-vector generator 1000 can perform a second search process over a subset of possible codebook code-vectors for a low weighted-domain error to produce a final fixed codebook code-vector $c_k^i$. The subset of possible codebook code-vectors can be based on the initial fixed codebook code-vector $c_k^{i*}$. As an example, the vector quantizer 1020 can perform the first search process according to the processes illustrated in FIGS. 6-8 and the post search 1030 can perform the second search processes according to the process illustrated in FIG. 9.

According to another example, the fixed codebook candidate code-vector generator 1000 can process the target vector $x_2$ through a plurality of inverse weighting functions $f(x_2, i)$ to create N residual domain target vectors b. The fixed codebook candidate code-vector generator 1000 can vector quantize the plurality of residual domain target vectors b to obtain a plurality of initial fixed codebook code-vectors $c_k^{i*}$, wherein each initial fixed codebook code-vector $c_k^{i*}$ can have a pre-determined number of unit magnitude pulses m. The fixed codebook candidate code-vector generator 1000 can evaluate an error value $\epsilon$ associated with each initial fixed codebook code-vector $c_k^{i*}$ to produce a final fixed codebook code-vector $c_k$.

According to another example, the fixed codebook candidate code-vector generator 1000 can vector quantize the residual domain target vector b to obtain an initial fixed codebook code-vector $c_k^i$. The initial fixed codebook code-vector $c_k^i$ can have a predetermined number of unit magnitude pulses m. The fixed codebook candidate code-vector generator 1000 can iterate the initial fixed codebook code-vector $c_k^i$ using a fixed codebook through a zero state weighted synthesis filter a plurality of times, such as discussed with respect to FIG. 9. The fixed codebook candidate code-vector generator 1000 evaluates at least one error value associated with each iteration of the initial fixed codebook code-vector $c_k^i$ from the plurality of times to produce a final fixed codebook code-vector $c_k$ based on an initial fixed codebook code-vector $c_k^i$ with a low error value.

Figure 11:
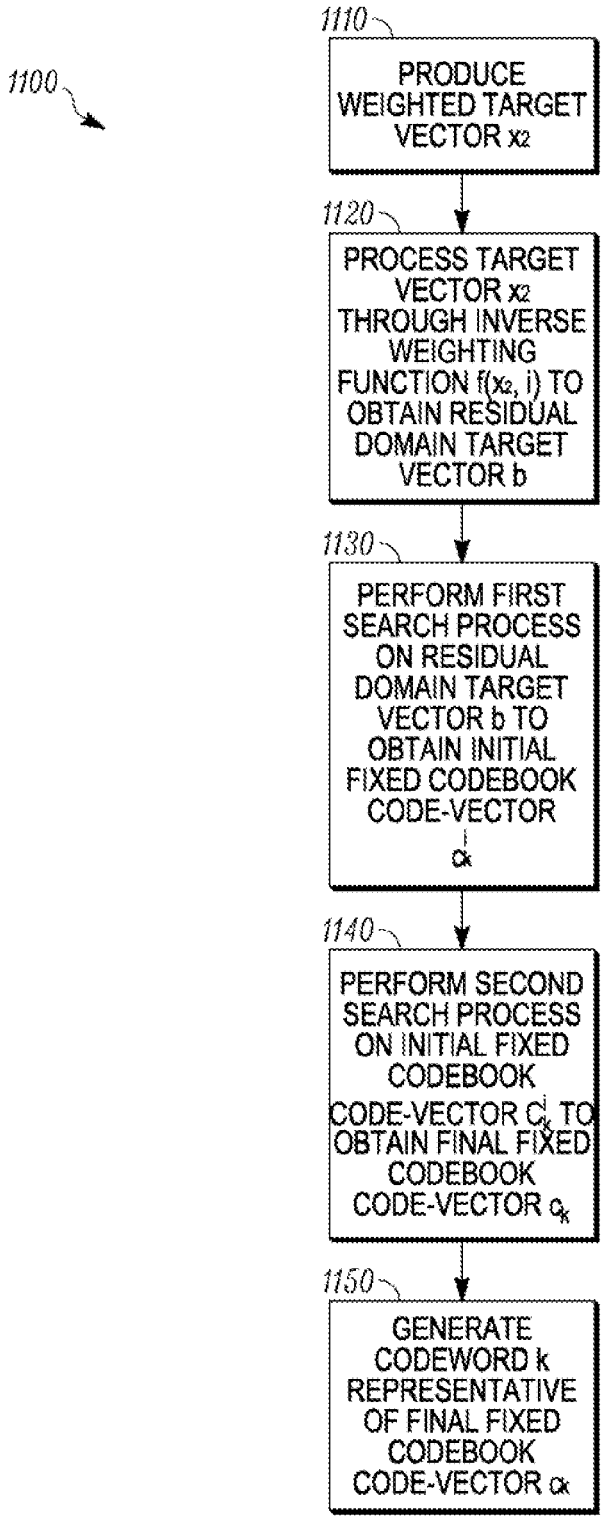
FIG. 11 is an example illustration of a flowchart outlining the operation of a coder according to one embodiment.
Figure 12:
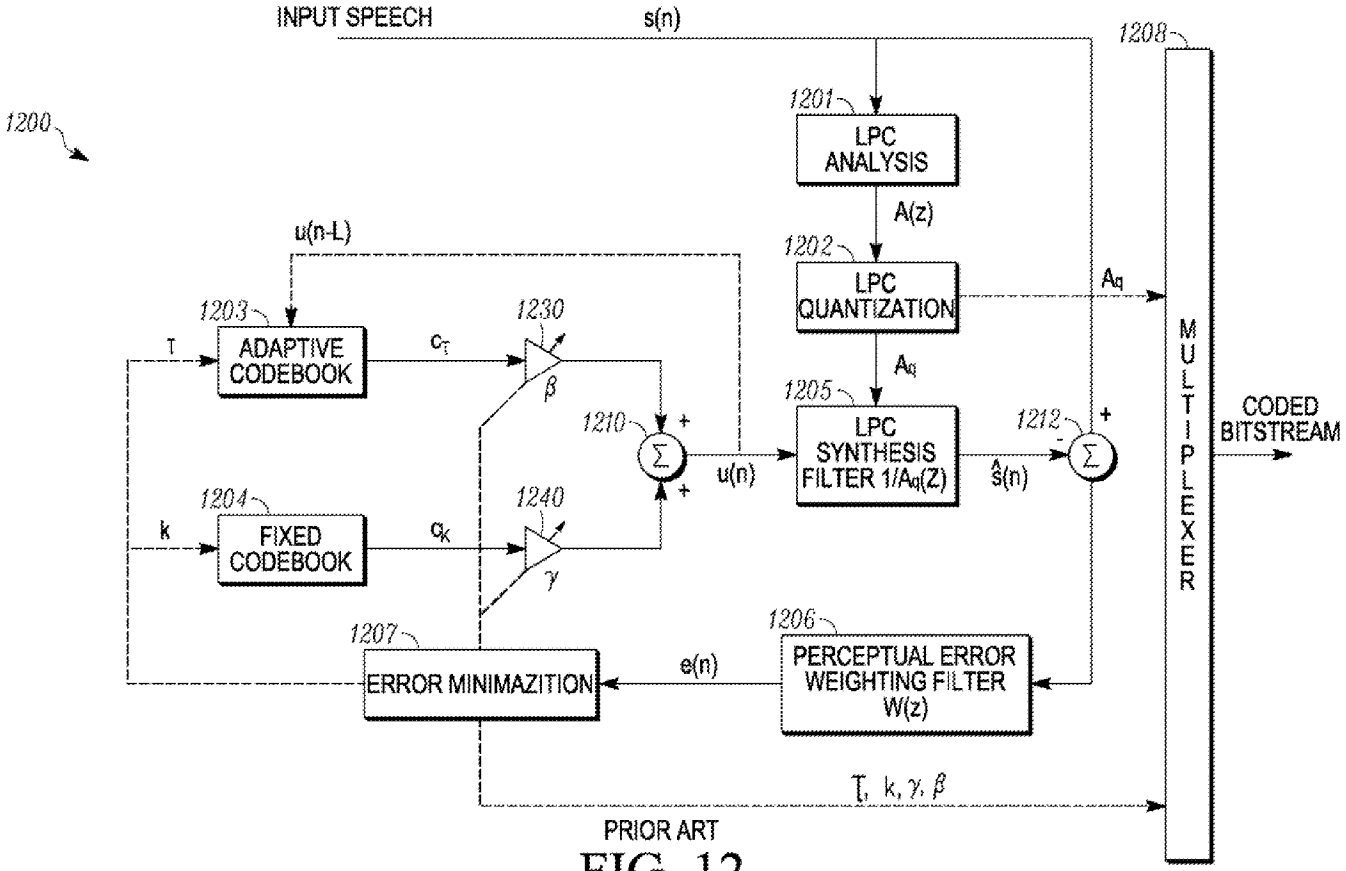
PRIOR ART FIG. 12
FIG. 12 is a block diagram of a Code Excited Linear Prediction (CELP) encoder of the prior art.
Figure 13:
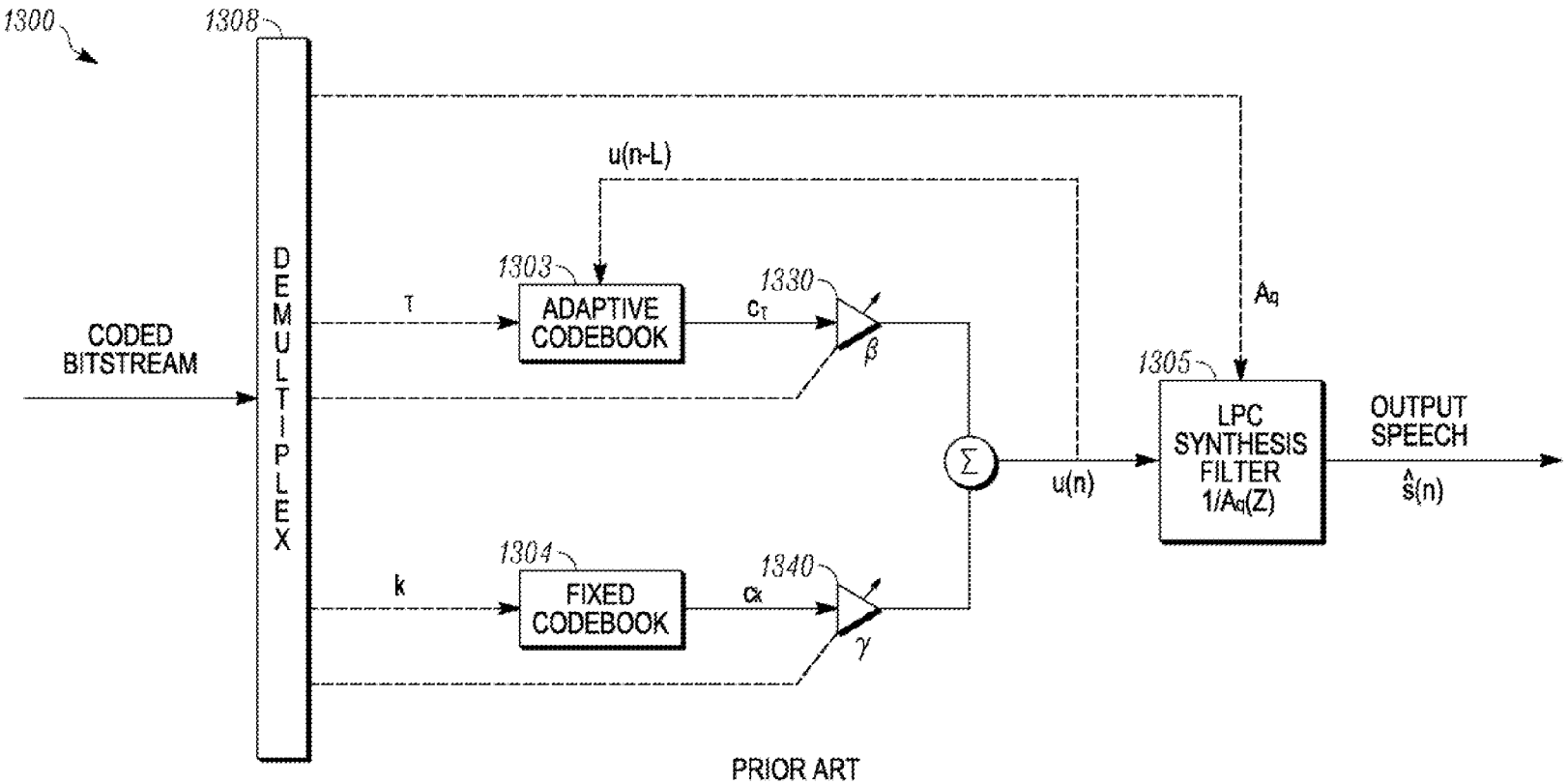
PRIOR ART FIG. 13
FIG. 13 is a block diagram of a CELP decoder of the prior art.

FIG. 11 is an example illustration of a flowchart 1100 outlining the operation of a coder, such as the coder 100, according to one embodiment. Elements 1120, 1130, and 1140 of the flowchart 1100 can illustrate operations of the fixed codebook code-vector generator 1000 from FIG. 10, which may be implemented using the fixed codebook candidate code-vector generator 110 and the FCB loop (i.e., fixed codebook 104, zero state weighted synthesis H equivalent 105, weighting block 141, combiner 108, error minimization block 107, and output 126) from FIG. 1. At 1110, the target vector generator 124 of the coder 100 can produce a weighted target vector $x_2$ from an input signal s(n). At 1120, the fixed codebook code-vector generator 1000 within the fixed codebook candidate code-vector generator 110 of the coder 100 can process weighted the target vector $x_2$ through an inverse weighting function $f(x_2, i)$ to create a residual domain target vector b. The coder 100 can obtain an inverse weighting function based on the weighted target vector $x_2$ to process the weighted target vector through the obtained inverse weighting function to create the residual domain target vector. See FIG. 2 and accompanying text.

At 1130, the fixed codebook code-vector generator 1000 within the fixed codebook candidate code-vector generator 110 of the coder 100 can perform a first search process on the residual domain target vector b to obtain an initial fixed codebook code-vector $c_k^i$. See FIGS. 6, 7, and 8 and accompanying text. The fixed codebook candidate code-vector $c_k^i$ can have a pre-determined number of unit magnitude pulses m. The coder 100 can perform the first search process on the residual domain target vector b for a low residual domain error to obtain the initial fixed codebook code-vector $c_k^i$. The coder 100 can perform the first search process by vector quantizing the residual domain target vector b to obtain the initial fixed codebook code-vector $c_k^i$, where the initial fixed codebook code-vector $c_k^i$ can include a pre-determined number of unit magnitude pulses. The coder 100 can perform a first search process or vector quantize the residual domain target vector b according to the processes illustrated in flowcharts 600, 700, or 800 and according to other processes disclosed in the above embodiments.

The first search process can include rounding a gain term applied to vector elements of the inverse weighting function to select a gain term such that a total number of unit amplitude pulses in the initial fixed codebook code-vector equals a given number. The first search process can include performing a median search quantization including finding an optimum pulse configuration satisfying a pulse sum constraint for a given gain and including finding an optimum gain for the optimum pulse configuration. The first search process can also include any other search or vector quantization process that obtains an initial fixed codebook code-vector.

At 1140, the FCB loop (i.e., fixed codebook 104, zero state weighted synthesis H equivalent 105, weighting block 141, combiner 108, error minimization block 107, and output 126) of the coder 100 can perform a second search process using flowchart 900 over a subset of possible codebook code-vectors based on the initial fixed codebook code-vector $c_k^i$ to look for a low weighted-domain error and produce a final fixed codebook code-vector $c_k$. The final fixed codebook code-vector $c_k$ can have a different number of pulses than the initial fixed codebook code-vector $c_k^i$. The subset of possible codebook code-vectors can be based on the initial fixed codebook code-vector $c_k^i$. The coder 100 can perform the second search process by iterating the initial fixed codebook code-vector $c_k^i$ through a zero state weighted synthesis filter equivalent using a fixed codebook a plurality of times and by evaluating at least one error value associated with each iteration of the initial fixed codebook code-vector $c_k^i$ from the plurality of times to produce a final fixed codebook code-vector $c_k$ based on an initial fixed codebook code-vector with a low error value. The second search process can include using a factorial pulse coded codebook to determine the final fixed codebook code-vector $c_k$. The second search process can also include the process illustrated in the flowchart 900 or can include other processes disclosed in the above embodiments.

At 1150, squared error minimization/parameter quantization block 107 of the coder 100 can generate an output 126 with a codeword k representative of the final fixed codebook code-vector $c_k$. The coder 100 can output the codeword by at least one of: transmitting the codeword and storing the codeword. The codeword k can be used by a decoder to generate an approximation of the input signal s(n).

The coder 100 can process, at 1120, the target vector $x_2$ through a plurality of inverse weighting functions $f(x_2, i)$ to create a plurality of residual domain target vectors b. The coder 100 can perform, at 1130, the first search process on the plurality of residual domain target vectors b to obtain a plurality of initial fixed codebook code-vectors $c_k^i$ where each initial fixed codebook code-vector $c_k^i$ can include a pre-determined number of unit magnitude pulses. The coder 100 can perform the second search process over a subset of possible codebook code-vectors for a low weighted-domain error based on an error value $\epsilon$ associated with each initial fixed codebook code-vector of the subset of possible codebook code-vectors to produce a final fixed codebook code-vector $c_k$. The subset of possible codebook code-vectors is based on the plurality of initial fixed codebook code-vectors $c_k^i$. The flowchart 1100 can also incorporate other features and processes described in other embodiments, such performed by the codebook candidate code-vector generator 1000.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

The invention claimed is:

1. A method for processing an input signal comprising:

producing a weighted target vector from the input signal;

processing the weighted target vector through an inverse weighting function to create a residual domain target vector;

performing a first search process on the residual domain target vector to obtain an initial fixed codebook code-vector;

performing a second search process over a subset of possible codebook code-vectors for a low weighted-domain error to produce a final fixed codebook code-vector, wherein the subset of possible codebook code-vectors is based on the initial fixed codebook code-vector;

generating a codeword representative of the final fixed codebook code-vector to generate an approximation of the input signal; and outputting the codeword by at least one of: transmitting the codeword over a communications channel and storing the codeword on a digital media device.

2. The method according to claim 1, wherein the performing the first search process includes performing a first search on the residual domain target vector for a low residual domain error to obtain the initial fixed codebook code-vector.

3. The method according to claim 1, wherein the performing the first search process includes vector quantizing the residual domain target vector to obtain the initial fixed codebook code-vector, where the initial fixed codebook code-vector includes a pre-determined number of unit magnitude pulses.

4. The method of claim 1, wherein the initial fixed codebook code-vector comprises a different number of pulses than the final fixed codebook code-vector.

5. The method of claim 1, further comprising obtaining the inverse weighting function based on the weighted target vector, wherein the processing comprises processing the weighted target vector through the obtained inverse weighting function to create the residual domain target vector.

6. The method of claim 1, wherein the processing comprises:

processing the weighted target vector through a set of inverse weighting functions to create a set of residual domain target vectors, wherein the performing a first search process comprises:

performing a first search on the set of residual domain target vectors to obtain a set of initial fixed codebook code-vectors where each initial fixed codebook code-vector includes a pre-determined number of unit magnitude pulses, and wherein the performing a second search process comprises:

performing a second search over the subset of possible codebook code-vectors for the low weighted-domain error based on an error value associated with each initial fixed codebook code-vector of the subset of possible codebook code-vectors to produce the final fixed codebook code-vector, where the subset of possible codebook code-vectors is based on the set of initial fixed codebook code-vectors.

7. The method of claim 1, wherein the performing a second search process comprises:

iterating the initial fixed codebook code-vector using a fixed codebook equivalently processed through a zero state weighted synthesis filter a plurality of times; and evaluating at least one error value associated with each iteration of the initial fixed codebook code-vector from the plurality of times to produce the final fixed codebook code-vector based on an initial fixed codebook code-vector with a low error value.

8. The method of claim 1, wherein the performing a first search process includes rounding a gain term applied to vector elements of an inverse weighting function output to select a gain term such that a total number of unit amplitude pulses in the initial fixed codebook code-vector equals a given number.

9. The method of claim 1, wherein the performing the first search process includes performing a median search quantization including:

finding an optimum pulse configuration satisfying a pulse sum constraint for a given gain; and finding an optimum gain for the optimum pulse configuration.

10. The method of claim 1, wherein the performing the second search process includes using a factorial pulse coded codebook to determine the final fixed codebook code-vector.

11. An apparatus comprising:

an input configured to receive an input signal;

a target vector generator configured to produce a weighted target vector from the input signal;

an inverse weighting function generator configured to process the weighted target vector through an inverse weighting function to create a residual domain target vector;

a fixed codebook candidate code-vector generator configured to perform a first search process on the residual domain target vector to obtain an initial fixed codebook code-vector and configured to perform a second search process over a subset of possible codebook code-vectors for a low weighted-domain error to produce a final fixed codebook code-vector, wherein the subset of possible codebook code-vectors is based on the initial fixed codebook code-vector; and a codeword generator configured to generate a codeword representative of the final fixed codebook code-vector to generate an approximation of the input signal; and an output configured to output the codeword, wherein the output is configured to output the codeword by at least one of: transmitting the codeword over a communications channel and storing the codeword on a digital media device.

12. The apparatus of claim 11, wherein the fixed codebook candidate code-vector generator includes a vector quantizer configured to perform the first search process by vector quantizing the residual domain target vector to obtain the initial fixed codebook code-vector, where the initial fixed codebook code-vector includes a pre-determined number of unit magnitude pulses.

13. The apparatus according to claim 11, wherein the fixed codebook candidate code-vector generator performs the first search process by performing a first search on the residual domain target vector for a low residual domain error to obtain the initial fixed codebook code-vector.

14. The apparatus of claim 11 wherein the initial fixed codebook code-vector includes a different number of pulses than the final fixed codebook code-vector.

15. The apparatus of claim 11, wherein the fixed codebook candidate code-vector generator is configured to obtain the inverse weighting function based on the weighted target vector, and wherein the fixed codebook candidate code-vector generator processes the weighted target vector through the obtained inverse weighting function to create the residual domain target vector.

16. The apparatus of claim 11, wherein the fixed codebook candidate code-vector generator processes the weighted target vector through a set of inverse weighting functions to create a set of residual domain target vectors, wherein the fixed codebook candidate code-vector generator performs the first search process on the set of residual domain target vectors to obtain a set of initial fixed codebook code-vectors, where each initial fixed codebook code-vector includes a pre-determined number of unit magnitude pulses, and wherein the fixed codebook candidate code-vector generator performs the second search process over the subset of possible codebook code-vectors for the low weighted-domain error based on an error value associated with each initial fixed codebook code-vector of the subset of possible codebook code-vectors to produce the final fixed codebook code-vector, where the subset of possible codebook code-vectors is based on the set of initial fixed codebook code-vectors.

17. The apparatus of claim 11, wherein the fixed codebook candidate code-vector generator is configured to perform the second search process by iterating the initial fixed codebook code-vector using a fixed codebook equivalently processed through a zero state weighted synthesis filter a plurality of times, and evaluating at least one error value associated with each iteration of the initial fixed codebook code-vector from the plurality of times to produce the final fixed codebook code-vector based on an initial fixed codebook code-vector with a low error value.

18. The apparatus of claim 11, wherein the fixed codebook candidate code-vector generator is configured to perform the first search process by rounding a gain term applied to vector elements of the inverse weighting function to select a gain term such that a total number of unit amplitude pulses in the final fixed codebook code-vector equals a given number.

19. The apparatus of claim 11, wherein the fixed codebook candidate code-vector generator is configured to perform the first search process by finding an optimum pulse configuration satisfying a pulse sum constraint for a given gain, and finding an optimum gain for the optimum pulse configuration.

20. The apparatus of claim 11, wherein the fixed codebook candidate code-vector generator is configured perform the second search process by using a factorial pulse coded codebook to determine the final fixed codebook code-vector.

* * * * *